US010497225B1

(12) United States Patent
Strong et al.

(10) Patent No.: US 10,497,225 B1
(45) Date of Patent: Dec. 3, 2019

(54) DETERMINING OPENING OF PORTALS THROUGH ACOUSTIC EMISSIONS

(71) Applicant: Kali Care, Inc., Santa Clara, CA (US)

(72) Inventors: John Francis Strong, Saratoga, CA (US); Abhijit Kalamkar, Sunnyvale, CA (US); Sina Fateh, Sunnyvale, CA (US)

(73) Assignee: KALI CARE, INC., Santa Clara, CA (US)

( * ) Notice: Subject to any disclaimer, the term of this patent is extended or adjusted under 35 U.S.C. 154(b) by 0 days.

(21) Appl. No.: 16/544,621

(22) Filed: Aug. 19, 2019

Related U.S. Application Data

(63) Continuation-in-part of application No. 16/192,450, filed on Nov. 15, 2018, now Pat. No. 10,377,543, which is a continuation-in-part of application No. 15/885,681, filed on Jan. 31, 2018.

(51) Int. Cl.
*G08B 3/10* (2006.01)
*G10K 15/04* (2006.01)

(52) U.S. Cl.
CPC ..... *G08B 3/10* (2013.01); *G10K 15/04* (2013.01)

(58) Field of Classification Search
CPC ..... G08B 3/10; G10K 15/04
USPC ..... 340/572.8
See application file for complete search history.

(56) References Cited

U.S. PATENT DOCUMENTS 3,230,661 A * 1/1966 Gleason ..... A63H 5/00 446/74
5,130,696 A * 7/1992 Liebman ..... G08B 3/10 340/384.71
5,803,287 A * 9/1998 Kusz ..... B65D 41/0471 215/330
6,299,006 B1 * 10/2001 Samonek ..... B65D 23/00 116/112

(Continued)

FOREIGN PATENT DOCUMENTS

WO WO-2013120149 A1 * 8/2013

OTHER PUBLICATIONS

Acoustic Barcodes Passive, Durable and Inexpensive Notched ID Tags (Harrison et al Oct. 2012) (Year: 2012).*

(Continued)

*Primary Examiner* — Benyam Haile
*Assistant Examiner* — Mancil Littlejohn, Jr.
(74) *Attorney, Agent, or Firm* — Perkins Coie LLP

(57) ABSTRACT

"Smart" functionality is provided to "dumb" containers. A closure such as tape is provided with structural nonuniformity, such as holes punched to weaken the material or polymer printing to strengthen the material. Data is encoded in structural nonuniformity, so when the closure is torn, cut, or otherwise yields the data is encoded in the acoustic emission. The structural nonuniformity also may be readable optically or otherwise. Encoded data may include event detection (logging containers opening), package/product information (e.g., lot numbers, contents), validation (e.g., validation codes to distinguish authentic from counterfeit products), and user recognition (e.g., brand jingles, warning sounds). Closures may be made/dispensed with structural nonuniformity in place, and/or structural nonuniformity may be added to closures already securing a portal. Hand-held (Continued)

systems may dispense and/or modify closures with structural nonuniformity.

30 Claims, 23 Drawing Sheets

(56) References Cited

U.S. PATENT DOCUMENTS

| | | | | |
|---|---|---|---|---|
| 8,328,775 | B2 | 12/2012 | Gokhale et al. | |
| 9,283,150 | B2 * | 3/2016 | Bujalski | A61J 7/0076 |
| 9,918,905 | B1 * | 3/2018 | Howard | A61J 1/03 |
| 10,138,036 | B1 * | 11/2018 | Schwimer | B65D 51/248 |
| 2002/0000908 | A1 | 1/2002 | Burg et al. | |
| 2004/0155780 | A1 | 8/2004 | Rapchak | |
| 2004/0173642 | A1 | 9/2004 | Clifford et al. | |
| 2006/0186075 | A1 * | 8/2006 | Rainey | A45D 40/0068 215/202 |
| 2008/0110850 | A1 * | 5/2008 | Tilton | B65D 41/0471 215/330 |
| 2014/0088524 | A1 * | 3/2014 | Marx | A61F 9/0026 604/298 |
| 2014/0182584 | A1 | 7/2014 | Sutherland et al. | |
| 2014/0228783 | A1 | 8/2014 | Kraft | |
| 2014/0257206 | A1 | 9/2014 | Fateh | |
| 2015/0359667 | A1 | 12/2015 | Brue | |
| 2016/0106375 | A1 | 4/2016 | Leydon | |
| 2016/0283967 | A1 * | 9/2016 | Mitchell | G06Q 30/0226 |
| 2018/0327148 | A1 * | 11/2018 | Trahan | B65D 43/021 |

OTHER PUBLICATIONS

Lamello Passive Acoustic Sensing for Tangible Input Components Apr. 2015 (Year: 2015).*

Harrison, Chris, et al., "Acoustic Barcodes: Passive, Durable and Inexpensive Notched Identification Tags", Oct. 7-10, 2012, 4 pgs., Human-Computer Interaction Institute and Heinz College Center for the Future of Work Carnegie Mellon University, Pittsburgh PA, Cambridge, MA, Copyright 2012 ACM 978-1-4503-1580.

Savage, Valkyrie, et al., "Lamello: Passive Acoustic Sensing for Tangible Input Components", Apr. 18-23, 2015, 4 pgs., Adobe Research, UC Berkeley EECS, ACM 978-1-4503-4315, May 15, 2004; http://dx.doi.org/10.1145/2702123.2702207.

International Search Report and Written Opinion dated Apr. 12, 2019 for International Patent Application No. PCT/US2019/013291, 12 pages.

* cited by examiner

DETERMINING OPENING OF PORTALS THROUGH ACOUSTIC EMISSIONS

CROSS-REFERENCE TO RELATED APPLICATIONS

This application is a continuation-in-part of U.S. application Ser. No. 16/192,450 filed Nov. 15, 2018, which is a continuation-in-part of U.S. application Ser. No. 15/885,681 filed Jan. 31, 2018, both of which are incorporated herein by reference for all purposes.

FIELD OF THE INVENTION

Various embodiments concern determining, facilitating, and/or communicating the opening of portals such as packing boxes, sealed bottles, etc. More particularly, various embodiments relate to producing a purposed acoustic emission from a closure engaged with a portal, receiving that acoustic emission, and registering an event associated with that vehicle such as opening the portal. Various embodiments refer to carrying out such functions via arrangements as may not require "smart" functionality in/on the vehicle or acoustic emitter. Various embodiments also refer to carrying out such functions via arrangements as may be material/mechanical in nature. Embodiments include but are not limited to frangible webs such as tapes, and/or other single-use mechanisms.

BACKGROUND

Point-of-action data associated with events such as opening a container or other portal may be useful in various capacities. Merely detecting such an event may be of interest. For example, determining when packaging for a medication is opened may facilitate tracking of medication use (e.g., using the opening of a packing box for eye drops as an indication that eyedrops have been acquired and are available for use, the opening of a safety seal thereon as an indication of first use, etc.) so as to support adherence to a prescribed medication treatment regimen, provide data for clinical studies, etc. Communicating information at time-of-action, such as the lot number of a produce, name, contents, etc. may facilitate use tracking and/or other functions. Providing validation data, e.g., a "code" as may identify genuine items may facilitate the verification that medication or other products are not counterfeit (for example, if a numerical code for a genuine article produces a predicted result when transformed by a complex and/or confidential mathematical algorithm, then it may be inferred that the code was assigned by an authorized manufacturer, e.g., someone with access to the algorithm). Facilitating user recognition, such as providing some positive confirmation of a user that the correct container is being opened, etc., also may be of interest.

At least in principle, certain forms of point-of-action data may be obtained or carried out through self-reporting; however, self-reporting may present certain concerns. For example, the accuracy and/or reliability of the data may be in question. Even with good intentions, users may not reliably remember or record when a package was opened, etc. Moreover, the degree of accuracy, reliability, in remembering/recording such information may be unknown. As another example, while validation may be attempted by user inspection, given a sufficiently sophisticated counterfeit an individual may be unable to reliably determine visually whether a given package of medication is genuine or not.

(Such concerns may apply similarly to validation by inspection for other products including but not limited to bottled water, foods, cosmetics, software, audio and/or video recordings, etc.)

Also at least in principle, certain point-of-action data may be actively reported by an autonomous system, e.g., by incorporating electronic sensors, processors, communication systems into a container or other portal. However this too may present challenges. Such components typically may require electrical power, and may be inoperable without power. Electronics may be susceptible to damage from various ambient conditions, e.g., if wet, dropped, sat upon (for example if kept in a pocket), exposed to extreme temperatures (for example if shipped in very hot or very cold weather without climate control), etc. Cost, complexity, potential contamination, weight, etc. also may be of concern.

BRIEF SUMMARY OF THE INVENTION

This disclosure contemplates a variety of systems, apparatus, methods, and paradigms for targeted and/or interactive approaches for determining the use of medication, identification of products, validation of products, and similar through emitting and interpreting acoustic emissions.

In one embodiment an apparatus is provided, including an adhesive tape adapted to engage flaps of a box, so as to retain the box in a closed state while the adhesive tape is engaged with the flaps, the adhesive tape being frangible so as to release the box from the closed state upon a rupturing of the adhesive tape. The adhesive tape defines apertures therethrough distributed along a rupture path, and is adapted such that the rupturing thereof produces an acoustic emission. The apertures are adapted to incorporate an acoustic sequential nonuniformity into the acoustic emission, and the apertures are configured along the rupture path so as to encode data, such that upon the rupturing the data is incorporated into the acoustic sequential nonuniformity in the acoustic emission.

In another embodiment an apparatus is provided, including a closure adapted to engage a portal, so as to retain the portal in a closed state while the closure is engaged with the portal, at least a portion of the closure being frangible so as to release the portal from the closed state upon a yielding of the at least one portion. The portion exhibits a yield sequential nonuniformity of a yield strength, and is adapted such that the yielding thereof produces an acoustic emission. The yield sequential nonuniformity is adapted to incorporate an acoustic sequential nonuniformity within the acoustic emission, and the yield sequential nonuniformity is configured so as to encode data, such that upon the yielding the data is incorporated into the acoustic sequential nonuniformity in the acoustic emission.

The closure may be a web. The web may be a foil, a metal, a paper, a textile, a plastic film, and/or a wire with an adhesive thereon.

The sequential nonuniformity of yield strength may include apertures defined through the closure. The apertures may exhibit non-uniform intervals therebetween, non-uniform size, and/or non-uniform shape. The sequential nonuniformity of yield strength may include weakenings of the closure. The weakenings may include indentations in the closure, perforations through the closure, scoring applied to the closure, voids defined in the closure, heat marks on the closure, chemical transformations of the closure, and/or a penetrating agent introduced into the closure. The weakenings may exhibit non-uniform intervals therebetween, non-uniform size, non-uniform shape, and/or non-uniform composition.

The sequential nonuniformity of yield strength may include reinforcements of the closure. The reinforcements may include substrate elements applied to the closure, heat marks on the closure, chemical transformations of the closure, a penetrating agent introduced into the closure, and/or a surface agent applied to the closure. The reinforcements may exhibit non-uniform intervals therebetween, non-uniform size, non-uniform shape, and/or non-uniform composition.

The closure may define a division therein between a first lane and a second lane, and the reinforcements may extend from the first lane to the second lane across the division. The division may exhibit an aperture in the closure. The division may exhibit a weakening of the closure.

The data may include a name of a contents associated with the closure, a manufacturer name of the contents, an ID number for the contents, a description of the contents, directions for a use of the contents, information regarding the contents, a manufacture date for the contents, a manufacture location for the contents, a lot number for the contents, a serial number for the contents, a use-by date for the contents, an ordering date for the contents, an ordering identity for the contents, a shipping date for the contents, a recipient for the contents, a prescriber for the contents, and/or a dispenser for the product. The data may include validation data for a contents associated with the closure adapted to facilitate distinction between authentic and counterfeit contents.

In another embodiment a method is provided, including establishing a closure adapted to engage a portal, so as to retain the portal in a closed state while the closure is engaged with the portal, at least one portion of the closure being frangible so as to release the portal from the closed state upon a yielding of the at least one portion, and the closure being adapted to produce an acoustic emission upon the yielding. The method also includes encoding data in the closure by manifesting a yield sequential nonuniformity of a yield strength along at least one portion of the closure, such that the yield sequential nonuniformity produces an acoustic sequential nonuniformity of the acoustic emission upon the yielding of the at least one portion.

The closure may include an adhesive tape.

Encoding the data in the closure may include manifesting a plurality of apertures in the closure. Encoding the data in the closure may include manifesting the apertures with nonuniform intervals therebetween, encoding the data in the closure includes manifesting the apertures with nonuniform size, and/or manifesting the apertures with nonuniform shape. Encoding the data in the closure may include applying a plurality of weakenings to the closure. Applying the weakenings may include establishing initiation points in the closure, defining perforations through the closure, applying scoring to the closure, excavating voids in the closure, and/or applying a penetrating agent to the closure. The weakenings may exhibit non-uniform intervals therebetween, non-uniform size, non-uniform shape, and/or non-uniform composition.

Encoding the data in the closure includes engaging a plurality of reinforcements with the closure. Encoding the data in the closure may include applying the reinforcements with nonuniform intervals therebetween, applying first reinforcements and second reinforcements with nonuniform size, applying the first reinforcements and the second reinforcements with nonuniform shape, and/or applying the first reinforcements and the second reinforcements with nonuniform composition. Engaging the reinforcements may include applying substrate elements to the closure, applying a penetrating agent to the closure, and/or applying a surface agent to the closure.

The data may include a name of a contents associated with the closure, a manufacturer name of the contents, an ID number for the contents, a description of the contents, directions for a use of the contents, information regarding the contents, a manufacture date for the contents, a manufacture location for the contents, a lot number for the contents, a serial number for the contents, a use-by date for the contents, an ordering date for the contents, an ordering identity for the contents, a shipping date for the contents, a recipient for the contents, a prescriber for the contents, and/or a dispenser for the product. The data may include validation data for a contents associated with the closure adapted to facilitate distinction between authentic and counterfeit contents.

In another embodiment an apparatus is provided, including means for establishing a closure adapted to engage a portal, so as to retain the portal in a closed state while the closure is engaged with the portal, at least one portion of the closure being frangible so as to release the portal from the closed state upon a yielding of the at least one portion, and the closure being adapted to produce an acoustic emission upon the yielding, and means for encoding data in the closure by manifesting a yield sequential nonuniformity of a yield strength along at least one portion of the closure, such that the yield sequential nonuniformity produces an acoustic sequential nonuniformity of the acoustic emission upon the yielding of the at least one portion.

BRIEF DESCRIPTION OF THE SEVERAL VIEWS OF THE DRAWINGS

Various objects, features, and characteristics will become more apparent to those skilled in the art from a study of the following Detailed Description in conjunction with the appended claims and drawings, all of which form a part of this specification. While the accompanying drawings include illustrations of various embodiments, the drawings are not intended to limit the claimed subject matter

Figure 1:
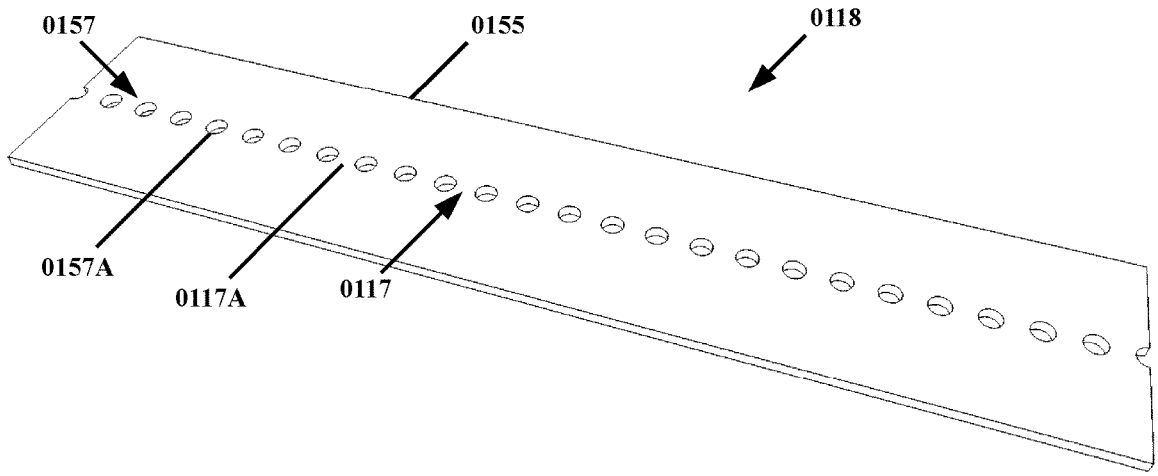
FIG. 1 shows an example acoustic emitter as may serve as a closure, in the form of a web with apertures therethrough, in perspective view.

The figures depict various embodiments described throughout the Detailed Description for the purposes of illustration only. While specific embodiments have been shown by way of example in the drawings and are described in detail below, the technology is amenable to various modifications and alternative forms. The intention is not to limit the technology to the particular embodiments described. Accordingly, the claimed subject matter is intended to cover all modifications, equivalents, and alternatives falling within the scope of the technology as defined by the appended claims.

Now with reference to FIG. 1, frangible materials and/or structures may be suitable in producing acoustic emissions, and/or features such as voids or other nonuniformities may contribute to the production of acoustic emissions. In FIG. 1 (and certain other figures as follow) an example arrangement is presented as may produce acoustic emissions through a combination of frangibility of an acoustic emitter and structural nonuniformity thereof. More particularly, the arrangement in FIG. 1 shows an acoustic emitter 0118 in the form of a web 0155 of material, such as a paper or plastic tape as may serve as a closure for a box or similar (e.g., being coated with adhesive on one side). For example, with such tape adhered to flaps of a box, the tape may retain the flaps in a closed state, releasing the flaps from a closed state (and allowing contents to be removed from or added to the box, etc.) when the tape is torn.

As may be seen, in the arrangement of FIG. 1 the web 0155 exhibits apertures 0157 therethrough (not all apertures 0157 shown are individually numbered, though one individual aperture 0157A is identified for reference), with spacings 0117 between apertures 0157 (though again not all spacings 0117 are individually numbered one such spacing 0117A is identified for reference). Such apertures 0157 may be considered as nonuniformities in the structure of the web 0155, which in turn may cause the web 0155 to exhibit nonuniformity of yield strength. (It may be valid to consider the spacings 0117 between apertures 0157 to be nonuniformities, in addition to or instead of considering the apertures 0157 as such. For simplicity, at least with regard to FIG. 1 and certain other examples herein, the apertures 0157 are referred to as "being" the nonuniformity.) For example, as the web 0155 is torn, cut, or otherwise ruptured or separated along a path following the apertures 0157, the yield strength of the web 0155 may be low (e.g., zero) at the apertures 0157 themselves (where there is no web material), and higher in the spacings 0117 between apertures 0157 (where there is web material). The nonuniformity of yield strength in the web 0155 in a path along the apertures 0157 in turn may cause a nonuniformity of an acoustic emission produced by the yielding of the web 0155, e.g., little or no acoustic amplitude at the apertures 0157 but higher acoustic amplitude in the spacings 0117 of web 0155 between apertures 0157.

With regard to "yielding", the term may encompass various modes of separation, destruction, and/or removal of a web or other structure. Considering an adhesive tape as an example, that tape may be said to "yield" when cut or torn, e.g., lengthwise along such tape engaged over a seam between flaps of a packaging box when the box is opened. In such instance it is the physical substance of the tape that yields, in that the tape itself is torn or cut apart. However, many other arrangements also may be suitable. Again considering an adhesive tape, such tape may be understood to "yield" when separated from a surface to which the adhesive is engaged, e.g., peeling away from a box. In such case the tape itself may be undamaged after being removed. For certain embodiments it may be suitable for the tape to be reused; for example, a tape with patterned pressure-sensitive adhesive may be removed and reapplied numerous times, at least potentially producing an acoustic emission each time. As another example, a binding strap with patterned hook-and-loop tape likewise may be removed and reapplied repeatedly, etc. Thus, it should be understood that yielding does not necessarily require physical destruction or change to the tape (or other acoustic emitter). Destructive and/or non-destructive modes of yielding may be suitable for various other embodiments as well.

It is also noted that not all embodiments necessarily must make a sharp distinction between destructive and non-destructive yield/acoustic emission. For example, certain emitters may be reusable (such as the pressure-sensitive adhesive or hook-and-loop tape examples referenced above), but may degrade or otherwise change over time, whether by design or incidentally. Whether such degradation is deliberate or incidental, it may be suitable to detect and/or evaluate such degradation. For example, an acoustic emission for a tape removed the first time may be distinguishable from one that has been removed more than once but fewer than 10 times, between 10 and 20 times, etc. Considering an adhesive tape, the adhesive and/or other elements may be configured to facilitate such distinctions (e.g., to produce specific wear patterns leading to specific changes in the acoustic emission as the tape is repeatedly used). Alternately, such adhesive may exhibit routine "wear and tear" without deliberate design, e.g., the adhesive may lose adhesion, peel or wear away, become brittle and crumble, etc., and such structural/functional changes may in turn manifest as changes to the acoustic emission. Through analysis of changes to the acoustic emission over time, the number of times a closure has been made to yield may be at least approximated. Such approximation may not require that every acoustic emission be detected, e.g., it may be inferred from changes to the acoustic emission that a closure has yielded (e.g., tape has been peeled away) at least 10 times since that acoustic emission was last detected, even if none of those presumed 10 yields was detected directly. Such age/use monitoring, while at least potentially useful for certain embodiments, may be suitable but is not required. So long as a suitable acoustic emission is produced and the closure in question no longer functions to retain the portal in a closed state (whether or not the closure is actually opened when the closure yields, e.g., some other mechanism may still hold shut the closure), modes and other particulars of yielding are not limited.

Figure 2:
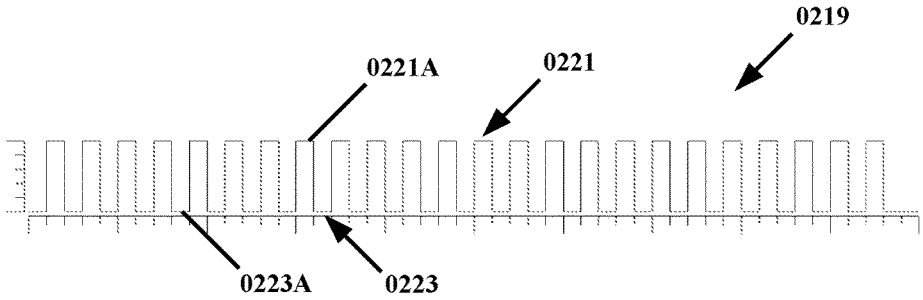
FIG. 2 shows an example plot of yield strength and/or acoustic amplitude as may correspond with a web with apertures therethrough.

FIG. 2 shows an example plot 0219 of yield strength and/or acoustic emission amplitude as may be produced yielding from left-to-right of a web such as is shown in FIG. 1, with the vertical axis representing yield strength/acoustic amplitude and the horizontal axis representing time. The plot 0219 shown in FIG. 2 may be understood as at least somewhat abstracted and/or idealized, for example no values are given for the vertical or horizontal axes (though hash marks are included for illustrative purposes). In practice the yield strength and/or the amplitude of acoustic emissions may vary considerably based on a variety of factors such as the specific materials in the web, the construction thereof, the thickness, whether the web is torn or cut, etc. Likewise, the rate at which acoustic emissions may be produced may vary. Furthermore, a real-world plot may exhibit "noise" or other irregularities, rather than a square wave arrangement such as is shown. The arrangement in FIG. 2 (and certain other such example plots herein) is presented as illustrative, and does not necessarily represent any specific physical embodiment.

As may be seen, the plot 0219 includes a plurality of individual pulses 0221 of non-zero sound amplitude (or alternately, non-zero yield strength) separated by intervals 0223 of zero sound amplitude, i.e., silence (or alternately, zero yield strength). For reference purposes one individual pulse 0221A is uniquely identified, as is one individual interval 0223A. When considering acoustic emission amplitude, the pulses 0221 may be considered as analogous to "notes" while the intervals 0223 therebetween may be considered as analogous to "rests". No indication of frequency or other acoustic properties is presented in FIG. 2, though as indicated elsewhere herein frequency also may vary, and/or may incorporate/communicate information, etc.

Care should be taking in considering the notion of "spaces" with regard to FIG. 1 and FIG. 2. While it may be valid to describe the portions of web 0155 between apertures 0157 in FIG. 1 as being "spaces" between the apertures 0157, in fact such "spaces" represent material while the apertures 0157 represent a lack of material. In addition, the "spaces" between apertures 0157 in FIG. 1 correspond to the pulses 0221 in FIG. 2 and not to the intervals 0123 therebetween. In colloquial terms, the holes produce spaces between sounds when the web is torn, but tearing the web at the spaces between holes is what produces the sounds themselves. Thus for purposes of clarity in the following discussion, "spacing" refers to distance between apertures, while "intervals" refers to time between sounds.

In comparing the plot 0219 in FIG. 2 with the emitter 0118 in FIG. 1, it may be observed that the intervals 0223 in FIG. 2 may correspond to the apertures 0157 in FIG. 1, and the pulses 0221 in FIG. 2 also may correspond to the spacings 0117 between apertures 0157 where portions of web 0155 remain. As FIG. 1 shows a series of apparently uniform apertures 0157 with apparently uniform spacings 0117, so too FIG. 2 shows a series of apparently uniform pulses 0221 separated by apparently uniform intervals 0223.

Given a web with regular and uniform apertures and spacings as shown in FIG. 1, it may be expected that the yield strength of that web may exhibit a regular and uniform pattern of highs and lows as shown in FIG. 2, and consequently the amplitude of sound produced as such a web yields may exhibit an acoustic emission with a regular and uniform pattern of pulses and intervals (as alternately shown in FIG. 2). For a given web, different configurations of yield strength and/or different configurations of acoustic emission may result from different configurations, e.g., apertures with different shape, size, etc., spacings of different size, etc. Thus, by varying the arrangement of apertures and/or spacings in a web or other closure (e.g., by punching a particular pattern of holes through a packing tape that may seal a box or bottle), data may be encoded in an acoustic emission that is to be produced when that closure is made to yield. Further example embodiments of such arrangements and variations (though by no means all possible embodiments) are presented for explanatory purposes with regard to succeeding figures herein.

Figure 3:
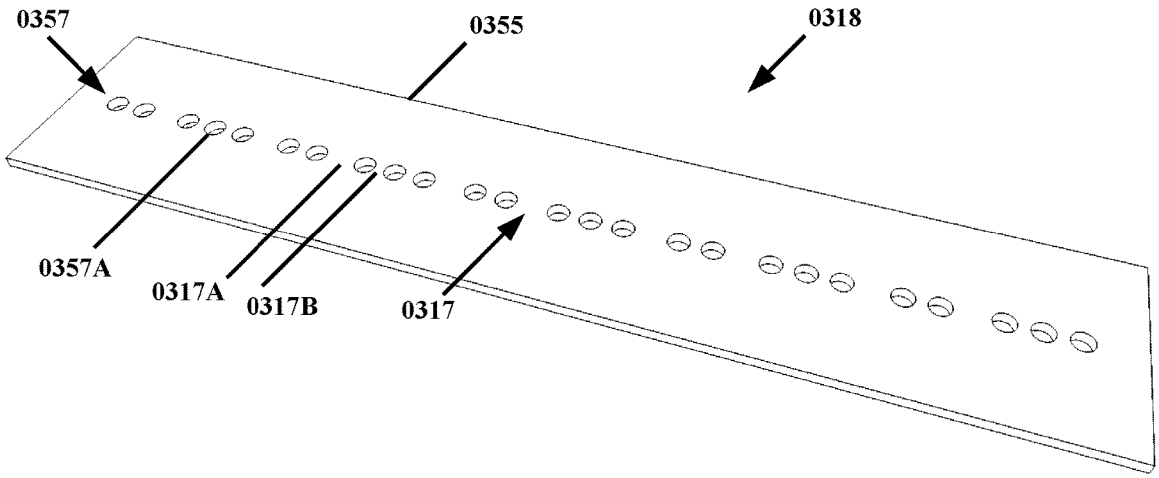
FIG. 3 shows an example acoustic emitter as may serve as a closure, in the form of a web with apertures therethrough exhibiting nonuniform spacing, in perspective view.

Turning to FIG. 3, another acoustic emitter 0318 in the form of a web 0355 of material is shown therein, again with apertures 0357 through the web 0355 (individual aperture 0357A identified for reference) and spacings 0317 therebetween. As may be seen, the apertures 0357 are visibly arranged in groups of two and three. In addition, two spacings 0317A and 0317B are individually identified for reference; as may be observed the spacings 0317 in FIG. 3 are not uniform, with spacing 0317A (between two groups of apertures 0357) being visibly larger than spacing 0317B (within a group of apertures 0357).

As noted with regard to FIG. 1, such apertures 0357 and/or spacings 0317 may be considered nonuniformities that may cause the web 0355 to exhibit nonuniform yield strength (low/none in the apertures 0357 and higher in the spacings 0317 between apertures 0357) and a nonuniform acoustic emission as the web 0355 is made to yield (e.g., being torn).

Figure 4:
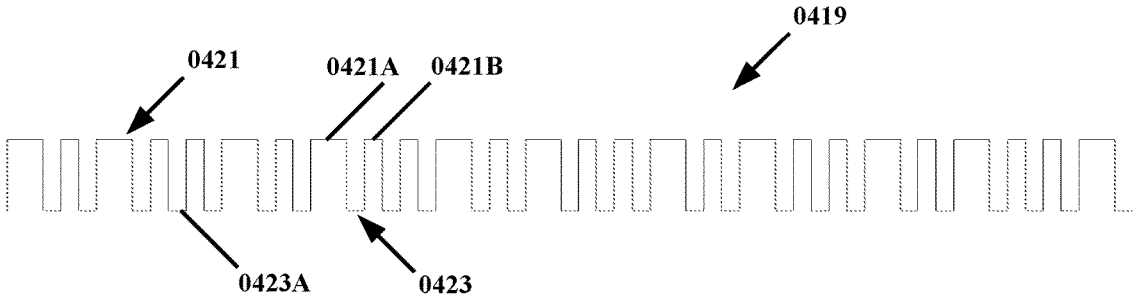
FIG. 4 shows an example plot of yield strength and/or acoustic amplitude as may correspond with a web with apertures therethrough exhibiting nonuniform spacing.

Now with reference to FIG. 4, an example plot 0419 of yield strength and/or acoustic emission amplitude is shown, as may be produced from the yielding from left-to-right of a web such as is shown in FIG. 3. The plot 0419 in FIG. 4 shows pulses 0421 of sound amplitude (or alternately, yield strength) separated by intervals 0423 of silence (or alternately, yield strength with intervals of no yield strength). For reference purposes two individual pulses 0421A and 0421B are uniquely identified, as is one individual interval 0423A. The intervals 0423 appear at least approximately similar in duration, however as may be seen the pulses 0421 are not all of equal duration. For example, pulse 0421A is visibly of longer duration than pulse 0421B.

Such greater duration of pulse 0421A compared to pulse 0421B (and other pulses 0421 shown) may be understood with reference back to FIG. 3 in noting that some spacings 0317 are dimensionally longer than others, e.g., spacing 0317A is longer than spacing 0317B. As may be understood, a larger physical spacing between apertures may equate to a longer pulse duration.

Thus, the configuration of apertures 0357 in FIG. 3 may correspond with the plot 0419 of acoustic emissions in FIG. 4. Colloquially, the sound produced may approximate "long/short/long/short/short/long/short/long/short/short . . . " While the example pattern presented is relatively simple for explanatory purposes, in practice varying the spacing among apertures may enable encoding data in an acoustic emission of indefinite length, complexity, data content, etc. Likewise, other physical features may be configured so as to produce other variations, as well; some such variations (though not necessarily all) are presented below as examples.

With regard specifically to the example of FIG. 3, it is noted that since all of the apertures 0357 are of at least approximately similar size and shape, thus an approach and/or mechanism may encode data for acoustic expression using a uniform implement, e.g., a single round punch adapted to produce apertures 0357 of the same size and shape as needed in a given web 0355. As a more concrete and colloquial example, a die may punch a sequence of round holes that do not themselves differ, yet still encode information by varying the physical spacing among the holes.

Figure 5:
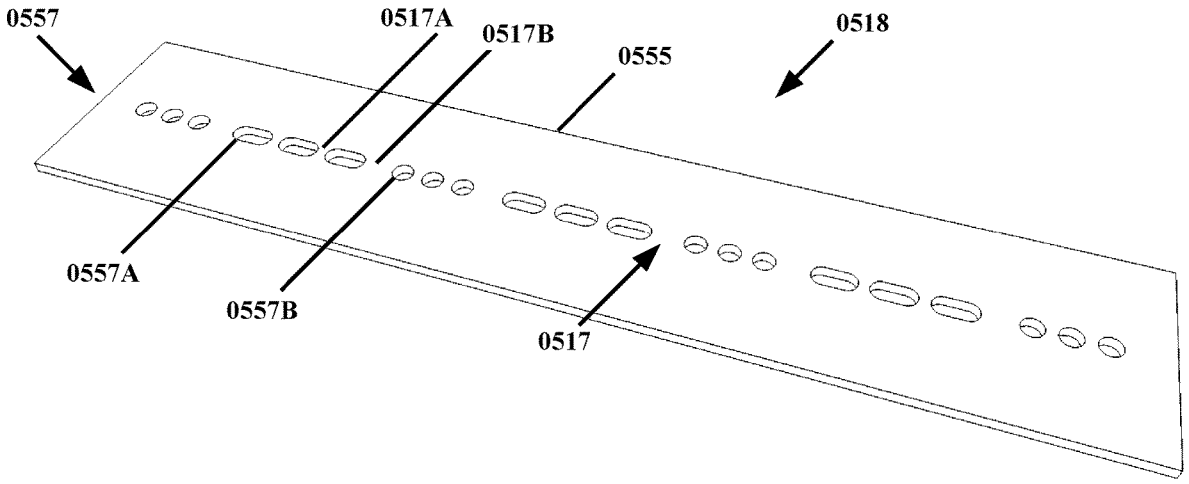
FIG. 5 shows an example acoustic emitter as may serve as a closure, in the form of a web with apertures therethrough exhibiting nonuniform size and spacing, in perspective view.

Now with reference to FIG. 5, an acoustic emitter 0518 in the form of a web 0555 of material is shown with apertures 0557 through the web 0555 (individual apertures 0557A and 0557B identified for reference) and spacings 0517 therebetween (individual spacings 0517A and 0517B identified for reference). As noted previously FIG. 3 exhibits nonuniform spacing among apertures therein; in FIG. 5 nonuniform spacings 0517 also may be observed, e.g., spacing 0517A is smaller than spacing 0517B. However, the acoustic emitter 0518 in FIG. 5 also exhibits nonuniform apertures 0557, e.g., aperture 0557A is longer than aperture 0557B. Collectively apertures 0557 may be seen to be arranged in groups of three, three short (circular) followed by three long (oval). The apertures 0557 and/or spacings 0517 may be considered nonuniformities that may cause the web 0555 to exhibit nonuniform yield strength and a nonuniform acoustic emission as the web 0555 is made to yield; in the example shown structural nonuniformity is exhibited not only in spacing but also size of apertures 0557.

Figure 6:
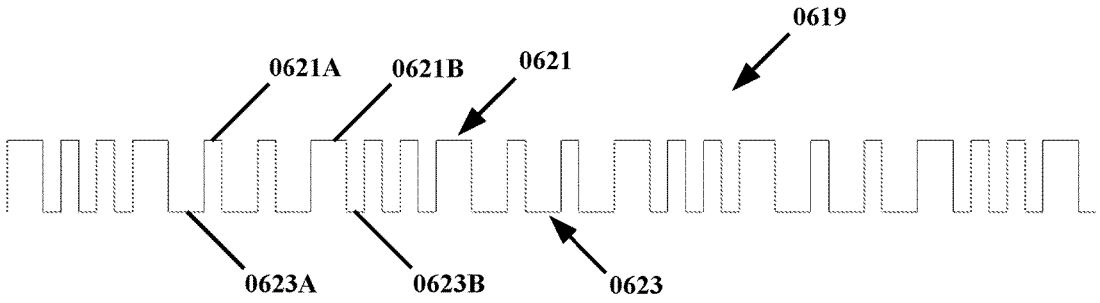
FIG. 6 shows an example plot of yield strength and/or acoustic amplitude as may correspond with a web with apertures therethrough exhibiting nonuniform size and spacing.

Turning to FIG. 6, an example plot 0619 of yield strength/acoustic emission amplitude is shown, as may correspond with a web as is shown in FIG. 5. The plot 0619 depicts pulses 0621 of sound amplitude/yield strength separated by intervals 0623 of silence/no yield strength. Two individual pulses 0621A and 0621B are uniquely identified, and two individual intervals 0423A and 0423B.

As may be seen, neither the pulses 0621 nor the intervals 0623 appear uniform. Rather, pulse 0621A is shorter than pulse 0621B, and interval 0623A is longer than interval 0623B. Such variations may be understood with reference to FIG. 5, e.g., different sizes of spacing may correspond with different durations of pulses 0621 while different sizes of apertures may correspond with different durations of intervals 0623. Thus, the configuration of apertures 0357 in FIG. 3 may correspond with the plot 0419 of acoustic emissions in FIG. 4. Varying the size of apertures and/or the spacing among apertures may enable encoding data in an acoustic emission; either or both may be utilized in a given embodiment, and/or in combination with other nonuniformities.

With regard specifically to the example of FIG. 5, as illustrated therein the dimensionally larger apertures 0557 such as aperture 0557A are illustrated as being distinct in shape compared to smaller apertures such as aperture 0557B (oval or lozenge-shaped as opposed to circular). Such an arrangement may be suitable, and may for example be produced through punching the web 0518 with two different punches. However, it may be equally suitable to produce apertures 0557 of effectively different dimension using only a single punch (or similar approach), for example by overlapping two circular apertures to produce one continuous aperture of greater length. Thus while arrangements with nonuniform apertures as may be produced through multiple tools/mechanisms may be suitable, the use of nonuniform apertures does not necessarily require multiple tools/mechanisms.

Figure 7:
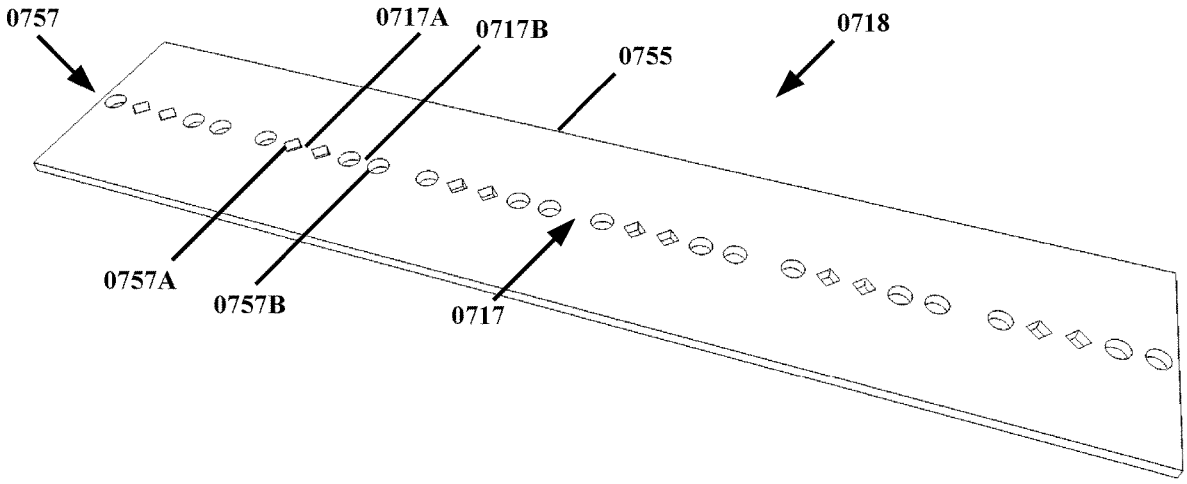
FIG. 7 shows an example acoustic emitter as may serve as a closure, in the form of a web with apertures therethrough exhibiting nonuniform shape and spacing, in perspective view.

Moving on to FIG. 7, an acoustic emitter 0718 in the form of a web 0755 of material is shown with apertures 0757 (apertures 0757A and 0757B identified for reference) and spacings 0717 (spacings 0717A and 0717B identified for reference). As may be observed, the apertures 0757 vary in shape, for example aperture 0757A appears diamond-shaped while aperture 0757B appears circular. It is noted that the apertures 0757 exhibit at least approximately the same dimensions left-to-right regardless of shape. As may be seen, the apertures 0757 are visibly grouped in sets of five, one circle followed by two diamonds followed by two more circles. It is pointed out that although spacings 0717 between groups of apertures 0757 may be visibly larger than spacings 0717 between apertures 0757 within a group thereof, the spacings 0717 among apertures 0757 within groups are at least approximately the same in dimension left-to-right as well.

Figure 8:
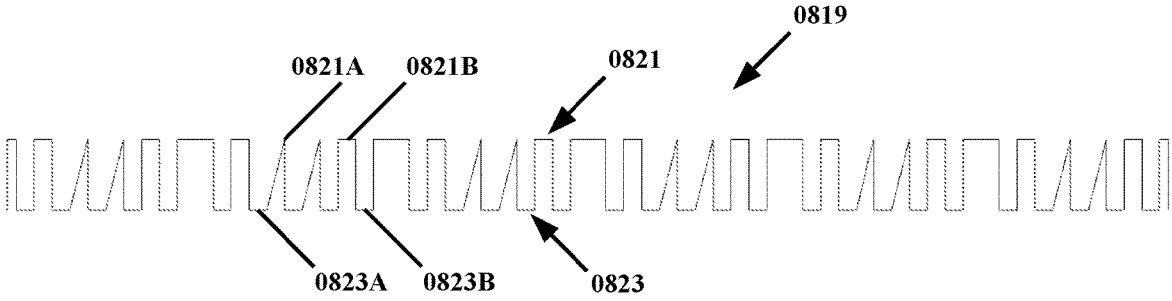
FIG. 8 shows an example plot of yield strength and/or acoustic amplitude as may correspond with a web with apertures therethrough exhibiting nonuniform shape and spacing.

In FIG. 8, an example plot 0819 of yield strength/acoustic emission amplitude is shown, as may correspond with a web as is shown in FIG. 7. The plot 0819 shows pulses 0821 of sound amplitude/yield strength separated by intervals 0823 of silence/no yield strength. Two individual pulses 0821A and 0821B are uniquely identified, and two individual intervals 0823A and 0823B.

As may be seen, pulses 0821A and 0821B are approximately equal in duration, but are of nonuniform shape. More particularly, pulse 0821A exhibits low initial amplitude/strength and then increases in amplitude/strength, while pulse 0821B exhibits at least approximately consistent amplitude/strength throughout the duration thereof. With reference back to FIG. 7, as noted therein certain apertures therein (such as aperture 0757A) exhibit a diamond shape while other apertures (such as aperture 0757B) appear circular. Such variations in aperture shape may affect acoustic pulses produced when a web yields; for example the initiation strength of a web yielding at a diamond-shaped aperture may be low compared to the initiation strength at a circular aperture, e.g., the sharp point of the diamond may present a stress concentration or weak point in yield strength, which in turn may result in lower initial acoustic amplitude.

As a result, as shown in FIG. 8, nonuniformities in strength/amplitude may be exhibited for a given web as may correspond with nonuniformities in aperture size (even for apertures of similar dimension). As may be seen, in FIG. 8 certain pulses such as pulse 0821A exhibit a "saw tooth" form while other pulses such as pulse 0821B exhibit a "square wave" form. Even though the duration and peak amplitude of acoustic pulses 0821A and 0821B may be similar (and the duration of intervals 0823 also may be similar), pulses 0821A and 0821B nevertheless are nonuniform compared with one another, and may be distinguished from one another. Information may be encoded based on such factors, i.e., factors not limited only to amplitude and duration. (Although variations in duration and/or amplitude are not excluded in such instances; as may be seen the duration of certain "square wave" pulses in FIG. 8 are longer than others, e.g., corresponding with larger spacings in FIG. 7).

It is noted that many factors may affect actual yield strength and/or acoustic amplitude for the yielding of a given web (e.g., web thickness, brittleness, material composition, yielding through tearing vs. cutting, etc.). Pointed spacing/aperture interfaces (e.g. at a diamond shaped aperture) may not necessarily produce a saw tooth form as shown in FIG. 8, nor will rounded spacing/aperture interfaces (e.g. at a circular aperture) necessarily produce a square wave form. While the arrangement in FIG. 8 is presented to illustrate potential nonuniformity in yield strength and/or acoustic amplitude, the particular shape of the plot 0819 is given as an example and not limiting.

Further, through inspection of FIG. 8 it may be understood that acoustic emissions may not be limited only to binary analysis, e.g., on or off, one or zero, sound or no sound, yield strength or no yield strength, etc. While binary arrangements are not excluded and may encode data therein, individual pulses 0821 and/or intervals 0823 may be distinguished by nonuniformity of duration, of amplitude vs. time (e.g., pulse "shape") etc. Through comparison of FIG. 7 with FIG. 8 it also may be understood that non-binary encoding may be achieved even when the physical structure of a given acoustic emitter 0718 may be understood as binary. That is, although at a given location the physical substance of the web 0755 in FIG. 7 either is present (at spacings 0717) or is not present (at apertures 0757), as may be seen in FIG. 8 an acoustic emission corresponding therewith need not be limited only to sound being present or not present. Features including but not limited to pulse shape, pulse amplitude, pulse duration, pulse frequency, etc. may be varied even for a simple acoustic emitter, thus facilitating a relatively high density of information encoded in a short duration and/or or small physical space (e.g., a short piece of web and/or small number of apertures).

Figure 9:
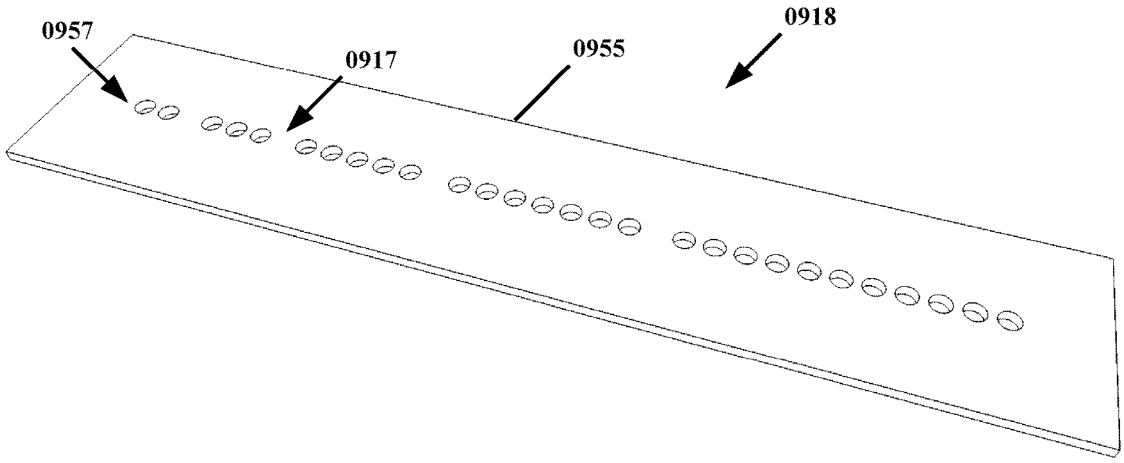
FIG. 9 shows an example acoustic emitter as may serve as a closure, in the form of a web with apertures therethrough encoding prime numbers, in perspective view.

Now with reference to FIG. 9, an acoustic emitter 0918 in the form of a web 0955 of material is shown with apertures 0957 and spacings 0917. As may be observed, the apertures 0957 are clustered together in linear groups. More particularly, apertures 0957 exhibit (from left to right) a group of two, a group of three, a group of five, a group of seven, and a group of eleven, i.e., prime numbers.

Figure 10:
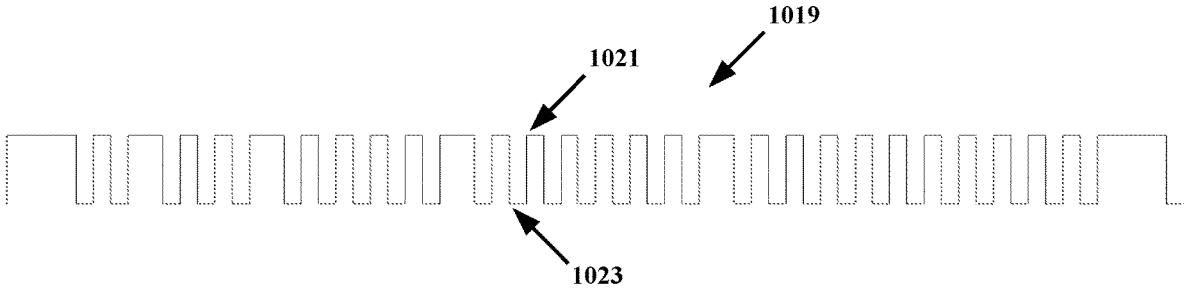
FIG. 10 shows an example plot of yield strength and/or acoustic amplitude as may correspond with a web with apertures therethrough encoding prime numbers.

FIG. 10 shows an example plot 1019 of yield strength/acoustic emission amplitude, as may correspond with a web as is shown in FIG. 9. The plot 1019 shows pulses 1021 of sound amplitude/yield strength separated by intervals 1023 of silence/no yield strength. The intervals 1023 exhibit grouping as may be seen to correspond with the grouping of apertures in FIG. 9, that is, the intervals 1023 in FIG. 10 exhibit (from left to right) a group of two, a group of three, a group of five, a group of seven, and a group of eleven, i.e., prime numbers as in FIG. 9.

Attention is drawn to two features of FIG. 10. First, an example may be observed therein of non-trivial data as may be presented through acoustic emission in response to defining apertures within a web, e.g., by punching holes in a strip of tape. While for illustrative purposes the grouping of intervals 1023 in FIG. 10 is relatively simple, nevertheless is should be understood that acoustic emissions may encode numbers, number sequences, etc. In turn number sequences may encode a wide range of data (nor is data encoding itself necessary limited only to numerical data). Consequently, the type and amount of data as may be encoded in acoustic emissions is not limited.

As a second feature of FIG. 10 attention also is drawn to the numerical information therein—a series of prime numbers—being encoded in the intervals 1023. That is, there are two intervals 1023 in one group, three intervals 1023 in the next, and so forth, as opposed to there being (for example) two pulses, then three pulses, etc. While encoding data explicitly in pulses is not excluded, as shown in FIG. 10 encoding data in intervals (e.g., using the "silences" as communication) may be suitable. (It is noted that in some sense encoding data in either of pulses and intervals may inherently embed at least some of that data in the other; that is, a plot such as plot 1019 may reasonably be considered as a series of sound pulses and/or as a series of intervals between sound pulses. However, it is explicitly noted that "counting silences" may be suitable instead of or in addition to "counting noises".)

Figure 11:
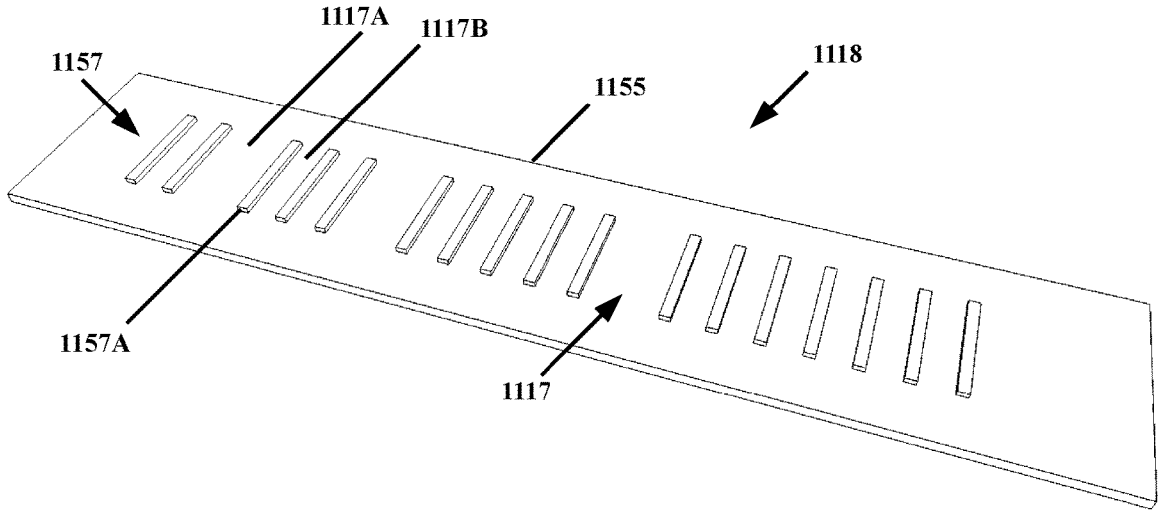
FIG. 11 shows an example acoustic emitter as may serve as a closure, in the form of a web with reinforcements thereon exhibiting nonuniform spacing, in perspective view.

Now with reference to FIG. 11, another acoustic emitter 1118 is shown, again in the form of a web 1155 of material. Unlike certain preceding examples the web 1155 in FIG. 11 does not exhibit apertures therethrough. However, as may be seen there are reinforcements 1157 disposed on the web 1155 (with one reinforcement 1157A uniquely identified for reference purposes). The reinforcements 1157 are separated from one another with spacings 1117; the spacings are nonuniform in dimension, e.g., spacing 1117A may be seen to be visibly longer (left-to-right) than spacing 1117B. Given the nonuniform spacings 1117 the reinforcements 1157 may be visually grouped into two, three, five, and seven reinforcements 1157 (e.g., prime numbers) as considered from left-to-right down the web 1118.

Attention is drawn to the reinforcements 1157 in FIG. 11. Therein the reinforcements 1157 are depicted as strips of additional material disposed on the surface of the web 1118, e.g., as strips of adhesive tape applied to the web 1118, thermoplastic powder deposited and heat-fused to the web 1118, lines of some dryable liquid printed or painted thereon, etc. (These are examples only, and other arrangements for reinforcing a web or other acoustic emitter may be suitable.) While adding reinforcement may differ from removing material to form apertures in a physical sense, conceptually and in terms of yield strength, acoustic emission, etc. some degree of similarity may be understood. That is, holes may be punched in a web to enable a nonuniform yield strength for that web, and/or a nonuniform acoustic emission when that web yields; likewise tape, fibers, etc. may be added to a web to enable a nonuniform yield strength/acoustic emission. Even if the web itself may be uniform absent such modification, the modification—whether that modification comprises removing material from the web, adding material to the web, modifying the material of the web, etc.—may provide suitable nonuniformity. Thus, although physically the example in FIG. 11 may differ from previous examples that utilize apertures, functionally a frangible web (or other emitter) that exhibits nonuniform weakenings may bear at least some similarity to a frangible web that exhibits nonuniform reinforcements (or nonuniform modifications of other sorts). It is emphasized that while certain examples herein may present weakenings, reinforcements, etc. for illustrative purposes, nonuniformity may take many forms, and is not limited only thereto.

Figure 12:
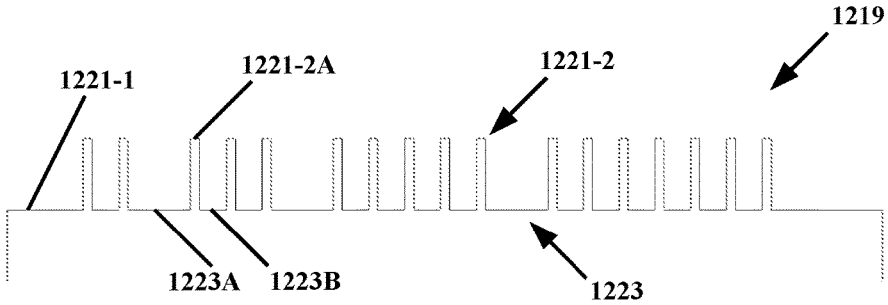
FIG. 12 shows an example plot of yield strength and/or acoustic amplitude as may correspond with a web with reinforcements thereon exhibiting nonuniform spacing.

Turning to FIG. 12, therein an example plot 1219 of yield strength/acoustic emission amplitude is shown, as may correspond with a web as is shown in FIG. 11. Various brief pulses 1221-2 of acoustic amplitude/yield strength may be seen in FIG. 12, as also may be seen in certain previous examples. However, a single long non-zero baseline level 1221-1 also as may be seen. Visibly, the pulses 1221-2 may be considered as being superposed on the baseline 1221-1. Through comparison with FIG. 11, it may be considered that the baseline 1221-1 in FIG. 12 may correspond with the body of the web in FIG. 11, while the pulses 1221-2 may correspond with the reinforcements shown in FIG. 11.

For purposes of explanation the baseline sound/strength 1221-1 as shown in FIG. 12 may be referred to herein as a pulse, more specifically as a first-order pulse 1221-1. While in a strict linguistic sense it may be arguable as to whether a prolonged sound constitutes a "pulse", for purposes of discussion and consistent with other features as shown and described with regard to various examples herein the term "pulse" may be applied to 1221-1. The visible instances of higher amplitude may be referred to as second-order pulses 1221-2. The number of orders of pulses as may be present in a given embodiment is not limited; an embodiment may include third-order pulses, fourth-order pulses, etc.

Strictly speaking, it may be accurate to refer to the intervals 1223 between the second-order pulses 1221-2 as being, likewise, second-order intervals. However, as only a single order of intervals is visible in the specific example of FIG. 12, for simplicity the intervals 1223 (and the uniquely identified intervals 1223A and 1223B) may be referred to only as "intervals" without qualifier. Where multiple orders of pulses are present, it may be suitable to refer similarly to multiple orders of intervals therebetween (as in certain later examples herein).

Viewed together, the plot 1219 shows second-order pulses 1221-2 of higher sound amplitude/yield strength separated by intervals 1223 of lower sound amplitude/yield strength. The intervals 1223 exhibit grouping as may be seen to correspond with the grouping of apertures in FIG. 11, that is, the intervals 1223 in FIG. 12 exhibit (from left to right) a group of two second-order pulses 1221-2, a group of three, a group of five, and a group of seven (prime numbers as in FIG. 11).

For example, assuming such a plot 1219 as in FIG. 12 were audible (e.g., in the proper frequency range, etc.) a human observer may hear a general baseline noise as a tape web tears (or was cut, etc.), with louder "pops" or other brief sounds as reinforcements on that web snapped (or were cut). Other recipients, such as a smart phone or other device, likewise may detect such acoustic emissions.

It is noted that, for simplicity, the plot 1219 in the example of FIG. 12 displays only one variable, e.g., acoustic amplitude. In such an example nonuniformity (e.g., groups of second-order pulses corresponding with prime numbers) is depicted as differences in acoustic amplitude. However, while nonuniformity of acoustic amplitude may be suitable for certain embodiments, other arrangements also may be suitable. For example, while second-order pulses 1221-2 are shown as having greater amplitude than the first order pulse 1221-1, it may also be suitable for pulses to exhibit different frequencies (e.g., a first-order "baseline" at 440 Hz and second-order pulses at 880 Hz). Other variations also may be suitable, and are not limited. In particular, it is emphasized that multiple types of nonuniformity may be present, e.g., variations in both amplitude and frequency, multiple different frequencies, etc.

Figure 13:
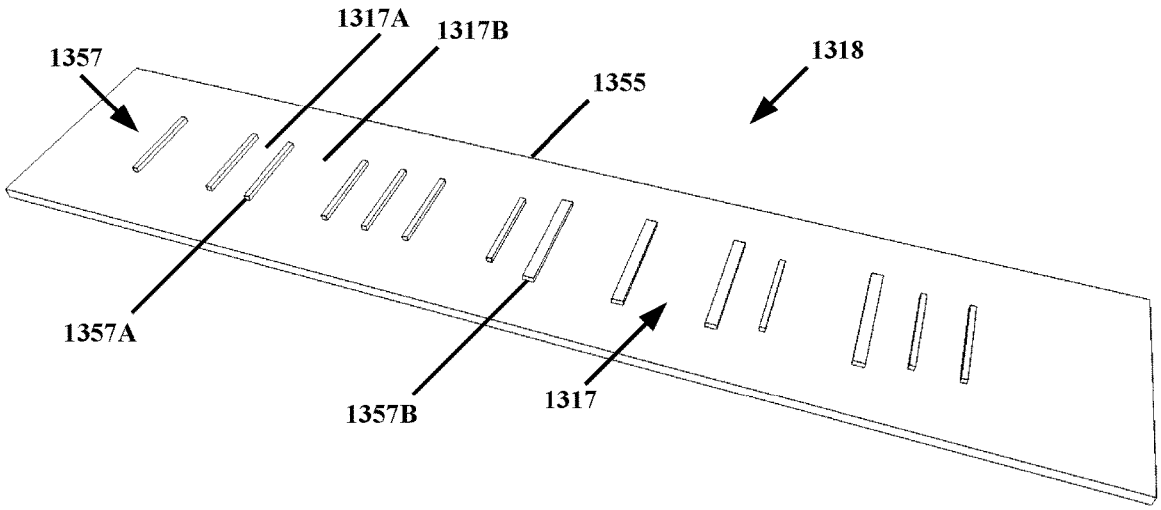
FIG. 13 shows an example acoustic emitter as may serve as a closure, in the form of a web with reinforcements thereon exhibiting nonuniform size and spacing, in perspective view.

Now with reference to FIG. 13, an acoustic emitter 1318 is shown in the form of a web 1355 of material with reinforcements 1357 thereon. Two such reinforcements 1357A and 1357B are uniquely identified for explanatory purposes. As may be seen, certain reinforcements 1357 are larger than others, e.g., reinforcement 1357B is visibly larger than reinforcement 1357A. Spacings 1317 between reinforcements 1357 also may be observed to vary, e.g., spacing 1317A is visibly smaller than spacing 1317B. Thus, at least in a visual sense the reinforcements 1357 may be considered as being arranged in groups, with smaller spacings such as 1317A within groups and larger spacings such as 1317B between groups. Viewed thus, it may be observed that the arrangement of reinforcements in FIG. 13 corresponds with a sequence of Roman numerals. That is, if the smaller reinforcements such as 1357A are considered as corresponding with Roman numeral I and the larger reinforcements such as 1357B are considered as corresponding with Roman numeral V, then the sequence from left to right along the web 1355 may be read as I, II, III, IV, V, VI, VII (or in Arabic numerals, 1, 2, 3, 4, 5, 6, 7).

It is pointed out that while certain acoustic emitters may encode data therein may not be legible to a human viewer (e.g., being concealed, or not exhibiting clear visible distinctions in structure, etc.), for other acoustic emitters some or all data encoded therein (if any) may be visible and/or comprehensible to a human observer. The arrangement in FIG. 13 may provide an example thereof: considering the web 1355 as a packing tape or safety seal, the various reinforcements 1357 may themselves be visible and distinguishable into two different sizes. Thus, a viewer familiar with Roman numerals may be able to read the numerical sequence encoded in FIG. 12. In certain embodiments it may be useful for encoded data to be detectable, legible, comprehensible, etc. to viewers, while in other embodiments it may be useful for encoded data to not be detectable, legible, and/or comprehensible. Embodiments are not limited in such regard.

Figure 14:
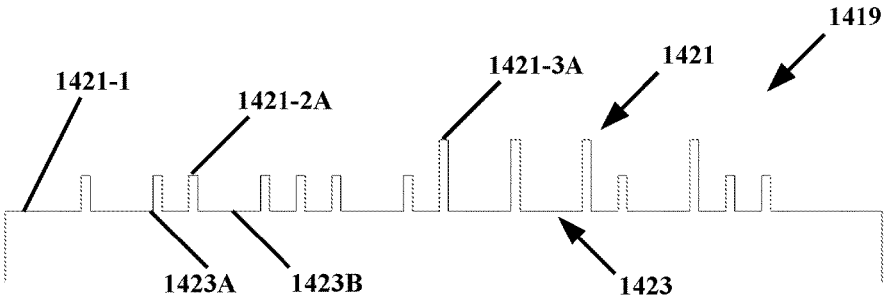
FIG. 14 shows an example plot of yield strength and/or acoustic amplitude as may correspond with a web with reinforcements thereon exhibiting nonuniform size and spacing.

Turning to FIG. 14, a plot 1419 of yield strength/acoustic emission amplitude is shown, as may correspond with a web as in FIG. 13. Pulses 1421 in acoustic amplitude/yield strength may be seen in FIG. 14; a baseline first-order pulse 1421-1 is shown, along with brief second order pulses such as 1421-2A exhibiting greater amplitude, and similarly brief third-order pulses such as 1421-3A exhibiting still great amplitude superposed on the first-order pulse 1421-1. (As the second-order and third-order pulses in FIG. 14 are intermingled, no attempt is made therein to collectively identify all second-order and third-order pulses as sets. Second-order pulses and third-order pulses may be distinguished by amplitude, e.g., through comparison with second-order pulse 1421-2A and third-order pulse 1421-3A. All pulses collectively are referenced as 1421.)

Plot 1419 may be seen to exhibit grouping of pulses 1421, specifically second-order and third-order pulses thereof, in an arrangement as may correspond with that of the reinforcements in FIG. 13. That is, considering second-order pulses as representing Roman number I and third order pulses as representing Roman numeral V, the plot 1419 may be understood as exhibiting a sequence I, II, III, IV, V, VI, VII in Roman numerals (and thus 1, 2, 3, 4, 5, 6, 7 in Arabic numerals).

It is noted that the arrangement in FIG. 14 may be understood to show that even for single-variable embodiments (e.g., only amplitude varies), acoustic emissions are not limited only to binary encoding. That is, the plot 1419 may be seen to have several amplitude levels, not only two: e.g., a zero amplitude, the baseline amplitude of first-order pulse 1421-1, the intermediate amplitude of second-order pulses such as 1421-2A, and the high amplitude of third-order pulses such as 1421-3A.

Thus, four amplitudes are shown in FIG. 14. Such an arrangement may facilitate sophisticated data encoding. For example, the baseline amplitude of the first-order pulse 1421-1 may be understood as a sort of "carrier" or "attention" signal, e.g., indicating that attention should be paid to possible transmitted data when the first-order pulse 1421-1 is detected (e.g., by a smart phone or other recipient). Superposed second-order and third-order pulses as shown such as 1421-2A and 1421-3A then may carry the transmitted data itself (with three levels even within the acoustic emission, baseline, intermediate, and high). Thus, while binary data encoding may be suitable, embodiments are not limited only to binary data encoding.

In addition, with regard intervals 1423 as shown in FIG. 14, therein intervals 1423 are distinguished by duration, e.g., short intervals such as 1423A within groups and longer intervals such as 1423B between groups. In the example of FIG. 14 intervals are not subdivided into first-order intervals (e.g., between second-order pulses) and second-order intervals (e.g., between third-order pulses); the example data of Roman numerals does not rely on distinguishing between multiple orders of intervals. However, in other embodiments it may be suitable to so distinguish among multiple orders of intervals. Indeed, it may be suitable to include multiple overlapping data sequences within a single acoustic emission, e.g., one data sequence utilizing (for example) second-order pulses and first-order intervals therebetween, and another independent data sequence utilizing third-order pulses and second-order intervals therebetween. Likewise, it may also be suitable for a single data sequence to encode information in both first-order and second-order intervals in cooperation (similarly to how the arrangement in FIG. 14 exhibits data encoded in second-order and third-order pulses in cooperation, e.g., groups of different amplitudes to represent groups of I characters and V characters to represent Roman numerals). While the arrangement in FIG. 14 is relatively simple for illustrative purposes, data encoding may be extremely complex and/or multi-dimensional, and is not limited.

Figure 15:
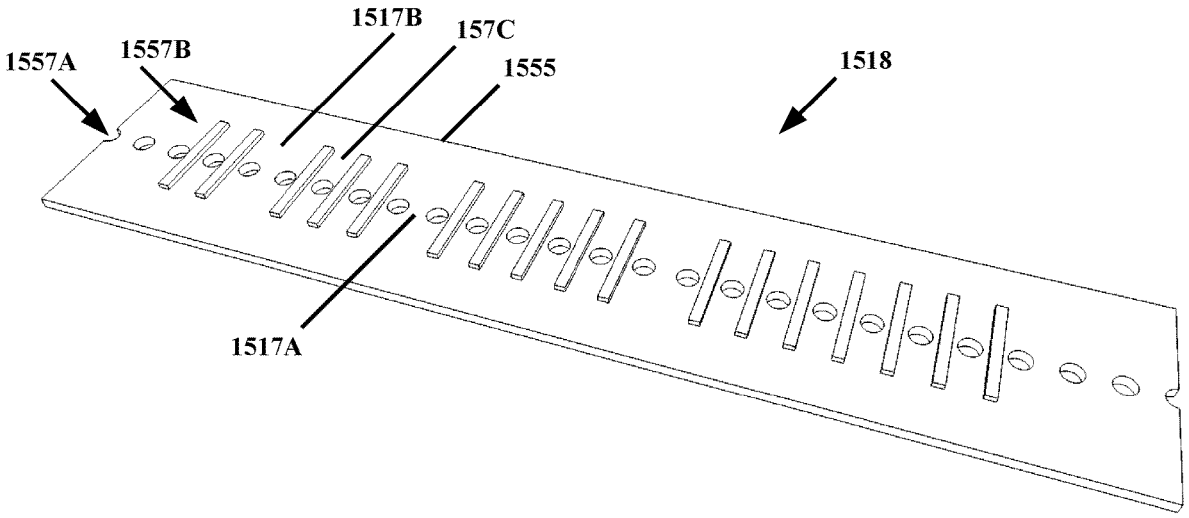
FIG. 15 shows an example acoustic emitter as may serve as a closure, in the form of a web with apertures therethrough and with reinforcements thereon exhibiting nonuniform spacing, in perspective view.

Now with reference to FIG. 15, an acoustic emitter 1518 is shown in the form of a web 1555 of material with apertures 1557A therethrough and reinforcements 1557B thereon. As may be understood from FIG. 15, embodiments are not limited to only one type of nonuniformity in yield-strength, or other mechanism or system for producing non-uniform acoustic emissions. For example as shown it may be suitable both to punch holes 1557A in a web 1555 (or to use a web that already has apertures 1557A therein, etc.) and also to dispose reinforcements 1557B on the same web 1555 (or to use a web already reinforced, etc.). Other combinations also may be suitable.

DETAILED DESCRIPTION OF THE INVENTION

In the example of FIG. 15, spacings such as 1517A between apertures 1557A may be observed to be at least approximately uniform. However, reinforcements 1557B may be observed to be spaced nonuniformly, e.g., spacing 1517B is visibly smaller than spacing 1517C. Thus the reinforcements 1557B may be understood to be arranged in groups. Considered so, it may be observed that the arrangement of reinforcements corresponds with a sequence of prime numbers, that is, groups of 2, 3, 5, and 7 reinforcements 1557B.

It is noted that intervals 1517A refer to intervals between apertures 1557A, while intervals 1517B and 1517C refer to intervals of different sizes between reinforcements 1557B and 1557C. Although some geometric overlap may exist—e.g., an interval 1517A between apertures 1557A may exist within a long interval 1517B between reinforcements 1557B as is visible in FIG. 15—the intervals 1517A between apertures 1557A and the intervals 1517B and 1517C between reinforcements 1557B may be independent of one another. That is, two distinct patterns may be present and/or may overlap, superpose, etc., e.g., one distribution of apertures 1557A and a second distribution of reinforcements 1557B.

Figure 16:
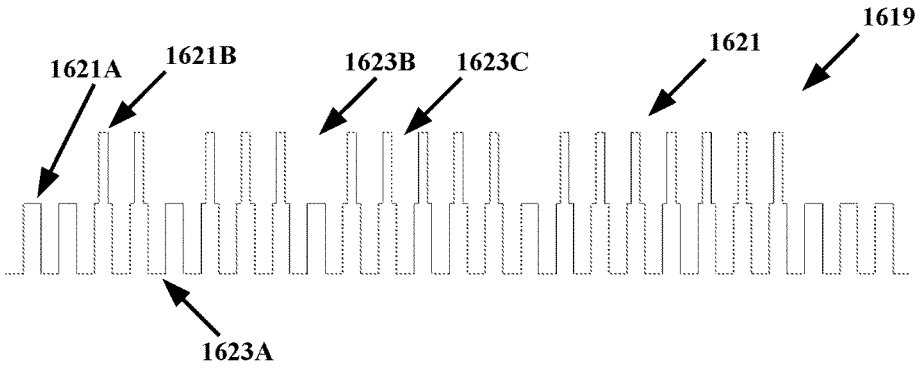
FIG. 16 shows an example plot of yield strength and/or acoustic amplitude as may correspond with a web with apertures therethrough and with reinforcements thereon exhibiting nonuniform spacing.

Turning to FIG. 16, a plot 1619 of yield strength/acoustic emission amplitude is shown, as may correspond with a web as in FIG. 15. First order pulses 1621A in acoustic amplitude/yield strength with relatively low amplitude but relatively long duration may be seen in FIG. 16, along second-order pulses 1621B with relatively high amplitude but briefer duration. In addition, as may be observed each second-order pulse 1621B is aligned with/superposed on a first-order pulse 1621A. Thus the arrangement in FIG. 16 may be considered to show a first series of regular pulses, with a second series of pulses superposed on some (but not all) of the first series.

Intervals 1623A between first-order pulses 1621A are visible, and may be observed to be at least approximately uniform. Second-order pulses 1621B may be observed to exhibit nonuniform distribution, with some intervals 1623B therebetween being longer than other intervals 1623B therebetween.

Thus plot 1619 may be seen to exhibit an arrangement as may correspond with that of the apertures and reinforcements in FIG. 15. That is, considering first-order pulses 1621A to be associated with apertures and second-order pulses 1621B to be associated with reinforcements, the plot 1619 may be understood as exhibiting a sequence of 2, 3, 5, 7 of prime numbers overlaid onto a regular repeating baseline sequence.

It is noted however that intervals 1623A in FIG. 16 may not necessarily correspond with apertures in FIG. 15 in precisely the same manner as intervals 1623B and 1623C in FIG. 16 may correspond with reinforcements in FIG. 15. Intervals 1623A may be understood as a lack of sound amplitude (or yield strength), with such a lack of sound amplitude corresponding with the apertures themselves. That is, the "no sound" periods may correspond to the holes. However, intervals 1623B and 1623C may be understood as reduced/zero sound amplitude corresponding not with the reinforcements themselves, but with the gaps between reinforcements. That is, the "low/no sound" pulses may correspond to spaces between reinforcements, rather than to the reinforcements themselves. Thus as may be understood from FIG. 15 and FIG. 16, different features may be considered with regard to generating acoustic nonuniformity (and/or encoding information therein, etc.), and embodiments are not limited with regard thereto.

In addition, it should be understood that to at least some extent identifying the specific physical structure(s) as may make up an acoustic emitter may be a matter of definition. For example, considering a web with apertures it may be that the spaces between apertures (where there is still web remaining to be torn, etc.) are the portion that literally produces the sound as the web yields. However, beginning for example with a continuous web and making holes through that web to produce a nonuniformity in an acoustic emission as the web yields, it may be understood in at least some sense that it is the holes that create and/or constitute the pattern of the acoustic emitter. However, for practical purposes, so long as a suitable nonuniformity of acoustic emission is produced such definitional questions may be academic, and are not limiting.

Furthermore, while the arrangement in FIG. 16 shows a uniform sequence of first-order pulses (as may correspond with a uniform sequence of apertures in FIG. 15) while only the second-order pulses in FIG. 16 (as may correspond with reinforcements in FIG. 15) is shown to exhibit more complex data (e.g., prime numbers), this is not limiting. For example, it may be equally suitable to encode two (or more) streams of information in a single emitter. As a more concrete example, apertures may be made through a web grouped so as to encode one string of data (e.g., prime numbers) in an acoustic emission from that web, while reinforcements may be grouped so as to encode a second pattern (e.g., Roman numerals). Such data streams may be entirely independent, or may inter-relate (e.g., an emitter may be configured so that a single sequence of data is produced redundantly by two distinct forms of acoustic nonuniformity), and are not limited in content or form.

Figure 17:
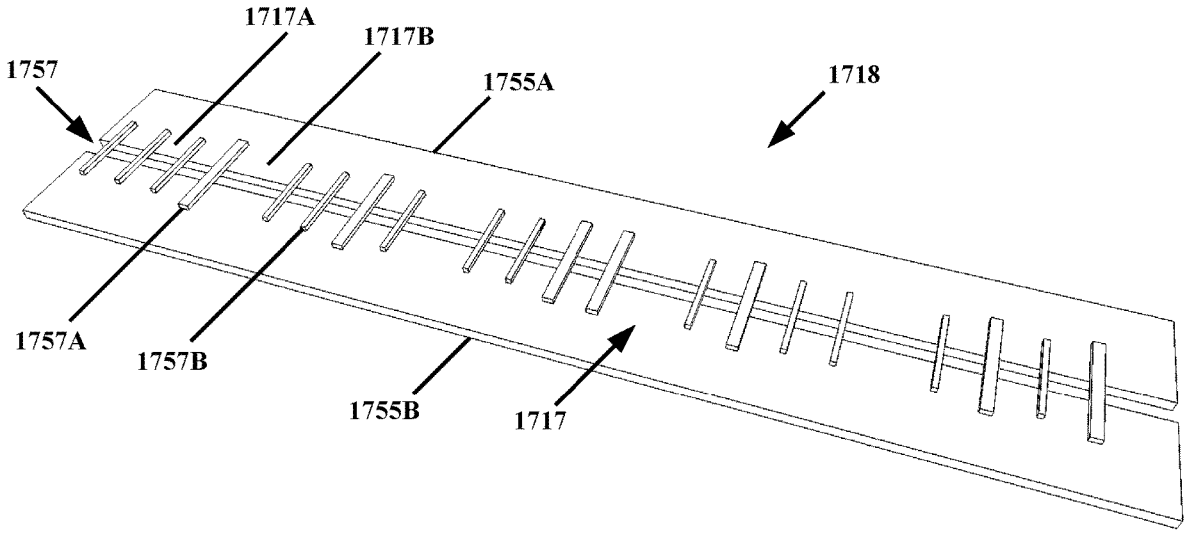
FIG. 17 shows an example acoustic emitter as may serve as a closure, in the form of a divided web with reinforcements thereon exhibiting nonuniform size and spacing, in perspective view.

Referring now to FIG. 17, an acoustic emitter 1718 is shown in the form of two distinct webs 1755A and 1755B of material, separated from one another. (Though the webs 1755A and 1755B as illustrated are a sufficient distance apart as to exhibit a visible gap therebetween, this is an example only. Embodiments with no dimensional gap, e.g., with webs that are physically distinct from one another but adjacent and in contact with one another, also may be suitable.)

Reinforcements 1757 are engaged with the first and second webs 1755A and 1755B, so as to bridge the gap therebetween. As may be seen, the reinforcements 1757 are of two sizes, some large such as reinforcement 1757A and some small such as reinforcement 1757B. As also may be seen, the spacings 1717 between reinforcements 1757 also are of two sizes, some short such as spacing 1717A and others long such as spacing 1717B. (Since the different sizes of reinforcements and spacings are intermingled, no attempt to collectively identify groups of reinforcements or spacings by size is shown in FIG. 17.)

As noted, the first and second webs 1755A and 1755B are distinct from one another, e.g., not part of a single integral whole. Thus neither of the first and second webs 1755A and 1755B necessarily must yield as the acoustic emitter 1718 as a whole yields. Thus, tearing or cutting the acoustic emitter 1718 down the length thereof may entail severing the reinforcements 1757, but may not entail tearing or cutting either of the first or second webs 1755A and 1755B themselves. In the example of FIG. 17 (unlike certain previous examples) the webs 1755A and 1755B may not contribute to the yield strength of the acoustic emitter 1718 and/or the production of acoustic emissions upon the yielding thereof; rather, yield strength and acoustic emissions may be defined wholly by the reinforcements 1757.

Considering the long spaces such as 1717B to divide the reinforcements 1757 into groups, and the larger reinforcements such as 1757A to each represent a 1 and the smaller reinforcements such as 1757B to each represent a 0, it may be observed that the example arrangement in FIG. 17 exhibits a sequence of four-digit binary numbers. That is, 0001, 0010, 0011, 1000, and 0101 (in base ten, 1, 2, 3, 4, and 5).

Figure 18:
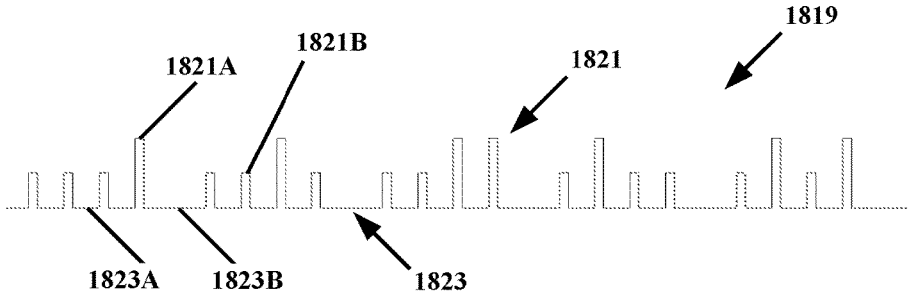
FIG. 18 shows an example plot of yield strength and/or acoustic amplitude as may correspond with a divided web with reinforcements thereon exhibiting nonuniform size and spacing.

Turning to FIG. 18, a plot 18219 of yield strength/acoustic emission amplitude is shown, as may correspond with an acoustic emitter as in FIG. 17. Pulses 1821 therein may be observed to be nonuniform: first order pulses 1821A in acoustic amplitude/yield strength with relatively low amplitude may be seen in FIG. 18, along with second-order pulses 1821B with relatively high amplitude. Intervals 1823 also may be observed to be nonuniform: relatively long second-order intervals such as 1823B are visible between groups of pulses 1821, while shorter first-order intervals such as 1823A are visible between pulses 1821 within groups.

Thus plot 1819 may be interpreted as exhibiting an arrangement as may correspond with that of the reinforcements in FIG. 17. That is, considering first-order pulses such as 1821A to represent is and second-order pulses such as 1821B to represent Os, the plot 1819 may be understood as exhibiting a binary sequence of 0001, 0010, 0011, 0100, 0101 (or 1, 2, 3, 4, 5 in decimal).

Only one property of acoustic pulses is illustrated as being variable in FIG. 18 (and certain other examples herein), that of acoustic amplitude (e.g., "volume"). That is, an acoustic emission corresponding with the plot 1819 may be described as exhibiting three sound levels: zero, low, and high. However, as noted previously, it is emphasized that this is an example only. Other properties including but not limited to acoustic frequency (e.g., "pitch") may be varied in addition to or instead of amplitude. Thus embodiments that exhibit variation in pitch rather than in volume may be suitable. (A comparison may be drawn between AM and FM radio signals, wherein variations in sound volume may be interpreted to resemble AM or amplitude modulated radio, while variations in sound pitch may be interpreted to resemble FM or frequency modulated radio.) Embodiments that exhibit variation in both pitch and volume, and/or other properties also may be suitable, and the number or type of properties of pulses, intervals, and/or other factors is not limited (nor are embodiments necessarily limited only to pulses and intervals, e.g., continuous sound may be suitable). Likewise, multiple "tracks" or "streams" of sound may be utilized, overlapping signals within a single stream, etc.

Returning to reference to FIG. 17, and as may be applicable to at least certain other examples herein, although the acoustic emitter 1718 may be configured so as to produce an acoustic emission as a signal (e.g., as may be received by a microphone and interpreted), it may be observed that the structure shown for producing that acoustic emission also may be distinctive in other ways, e.g., the arrangement of reinforcements 1757 shown may be visually readable or identifiable. Reinforcements may be visually identified as being in groups of four lines (reinforcements 1757) with some lines being different sizes (such as 1757A and 1757B), e.g., by a human observer or an optical device. Thus the information encoded (if any) within the structure of at least some acoustic emitters may be readable even before the acoustic emitter is produced. It is noted further that the particular example in FIG. 17—groups of lines of different size—may be understood to correspond to optical barcodes. Thus it may be that for at least some embodiments, a barcode reader may be able to read the structure of an acoustic emitter as a literal barcode, in addition to the acoustic emitter functioning as what may be described as an "acoustic barcode".

While such "dual use" functionality (e.g., structure as enables both acoustic barcode and optical barcode interpretations) is not required, dual use acoustic/optical barcodes (or other dual use arrangements, e.g., acoustic/magnetic) may enable certain useful features. For example, reading an optical barcode may be nondestructive and thus repeatable, where generating an acoustic barcode in an arrangement such as shown in FIG. 17 may be destructive and thus not repeatable (e.g., the reinforcements 1757 may only break and produce the acoustic emission once), while the two forms of data—optical and acoustic—may be readily distinguished. Thus, a single structure may facilitate both optical scanning for routine handling, shipping, inventory checks, etc. of a product, as well as distinctive one-time acoustic recognition of when the product is actually opened (e.g., by the end user). As a more concrete example, a single optical/acoustic barcode on a box for a medication may support repeatable optical scanning as the box is shipped, stocked, and sold, and also support single-use acoustic detection when the person who means to use the medication first opens the package. These examples are not limiting, and other applications and features of dual use encoding (whether as barcodes or otherwise) also may be exhibited and/or utilized.

Figure 19:
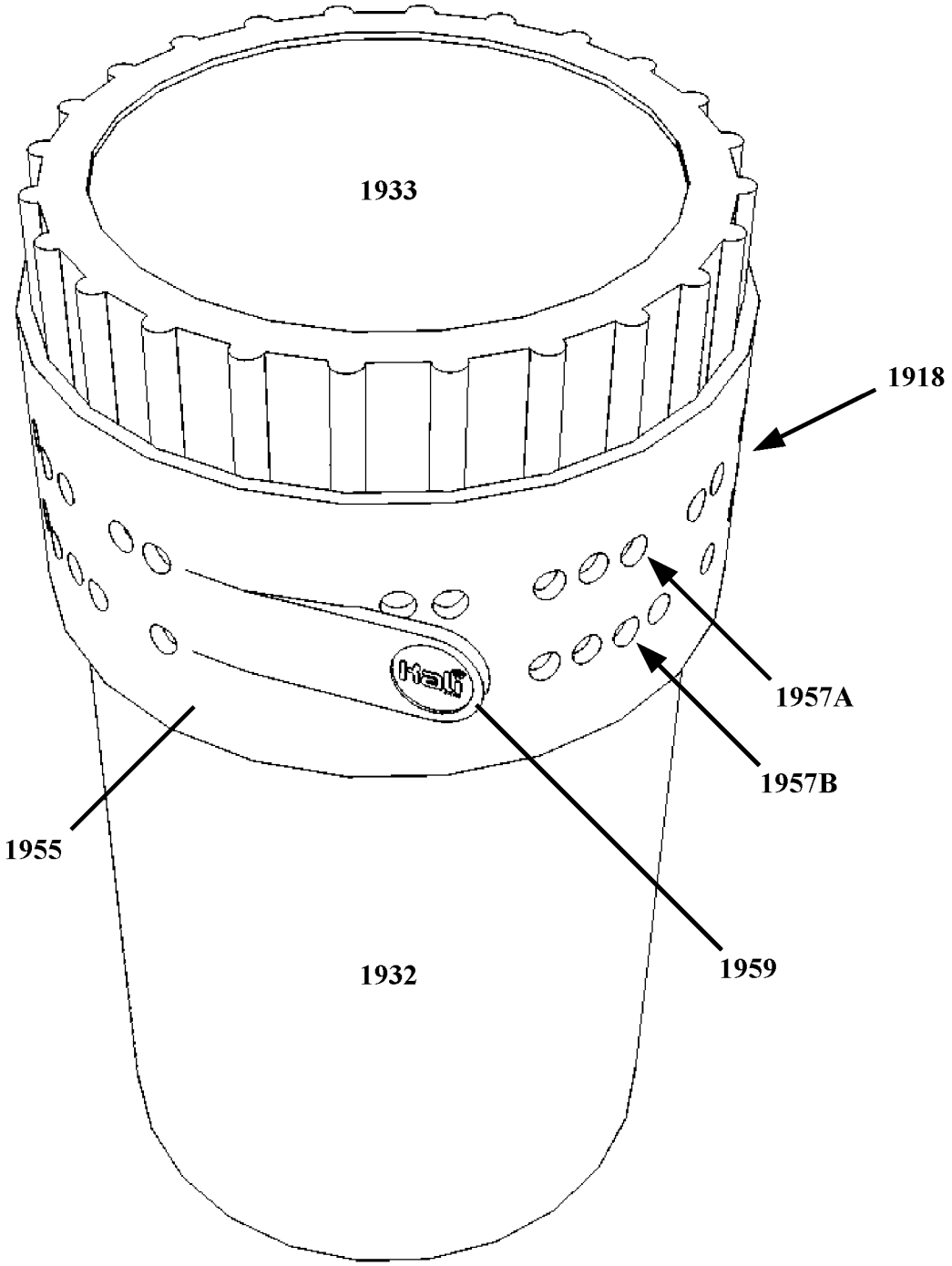
FIG. 19 shows an example acoustic emitter as may serve as a closure, engaged with a screw top bottle, in perspective view.

Now with reference to FIG. 19, certain previous examples herein present configurations as may be simplified and/or abstracted for purposes of clarity, e.g., a short flat segment of web as may be (but is not illustrated to be) engaged with a closure such as a bottle, box, etc. so as to enable production of an acoustic emission. The arrangement in FIG. 19 is presented as a more concrete example of an acoustic emitter as may be applied in practice (though by no means the only embodiment or application thereof).

In the example of FIG. 19, a container 1932 is visible, along with a cap 1933 engaged therewith. The container 1932 and cap 1933 are illustrated in the form of a bottle and screw top, e.g., as may contain a medication, though these are examples only. An acoustic emitter 1918 in the form of a closure is shown engaged with the container 1932 and cap 1933. In the particular arrangement illustrated, the acoustic emitter is a cylindrical sleeve that encircles a portion of the container 1932 and cap 1933; such an arrangement may resemble and/or function as a "safety seal" for the container 1932, e.g., a disposable structure that secures the cap 1933 to control access to the medication (or other contents) within the container 1932. Considering the interface between the container 1932 and the cap 1933 as a portal, e.g., for dispensing medication therethrough (such as through a mouth, not shown in FIG. 19), while the acoustic emitter 1918 (e.g., closure, safety seal, etc.) is engaged with that portal the acoustic emitter retains the portal in a closed state.

As illustrated, the acoustic emitter 1918 includes a web 1955 with apertures 1957A and 1957B defined therethrough, arranged in circumferential series of first apertures 1957A above and second apertures 1957B below. The acoustic emitter 1918 includes a separator 1959; an end thereof is visible in FIG. 19, though the separator 1959 may extend through the circumference of the acoustic emitter 1918. Given such configuration, the acoustic emitter 1918 may be understood to be frangible, such that pulling on the separator 1959 may cause the web 1955 to yield along the circumferential paths of the first and second apertures 1957A and 1957B. The web 1955 having thus yielded along the portions corresponding with the paths of the first and second apertures 1957A and 1957B, the portal (e.g., the cap 1933 as engaged with the container 1932) may be released from a closed state. More colloquially, in pulling the tab, a safety seal may be made to tear along lines of perforations therein, enabling the bottle to be opened by unscrewing the cap.

As noted with regard to certain previous examples herein, the presence of apertures 1957A and 1957B defined through the web 1955 may correspond with nonuniformity of yield strength, e.g., the material of the web 1955 yields with some level of applied force but no applied force may be necessary at the apertures 1957A and 1957B (there being no web material present in the apertures). The arrangement of the apertures 1957A and 1957B may encode information within the nonuniformity of yield strength, as previously described herein. Likewise, an acoustic emission as may be produced by yielding of the web 1955 also may exhibit nonuniformity, and may exhibit the encoded information within the properties of that acoustic emission. For example, the web 1955 may produce pulses of sound separated by intervals, etc.

Attention is drawn to the arrangement of apertures as first and second apertures 1957A and 1957B. In pulling the separator 1959 to cause the web 1955 to yield, e.g., so as to produce an acoustic emission, the web may yield along two paths concurrently, that is, along the path of the first apertures 1957A and also along the path of the second apertures 1957B. Thus, an acoustic emission produced thereby may exhibit two concurrent "channels" or "streams" of sound; with each of the first and second apertures 1957A and 1957B exhibiting different arrangements as shown, first and second channels of an acoustic emission therefrom may encode two different channels or streams of data therein. That is, an arrangement such as is shown in FIG. 19 may produce two distinct patterns of sound, either or both of which may carry data therein.

The number of tracks of parallel data as may be encoded are not limited; the example embodiment in FIG. 19 presents two such channels, but arrangements with only one channel, or with three or more, also may be suitable. In addition, while the arrangements of first and second apertures 1957A and 1957B as shown are different, this too is an example only. Arrangements wherein multiple channels carry the same data may be suitable, as may arrangements wherein data of multiple channels is interrelated, intermingled, wholly distinct, etc.

It is also noted that while the arrangement in FIG. 19 illustrates a container 1932 and cap 1933 for clarity, the container 1932 and cap 1933 are not necessarily part of the acoustic emitter 1918 as such. For example, an acoustic emitter 1918 in the form of a safety seal may be produced separately from the container 1932 and cap 1933 shown (and/or other packages, portals, etc.) and then applied thereto, e.g., as a subsequent manufacturing step, as a retrofit, etc. Further, while the term "safety seal" is presented for explanatory purposes, it should not be considered that embodiments are limited only to configurations as may operate as a safety seal. For example, as noted previously herein acoustic emitters may facilitate tracking of the use or opening of containers, etc. Nor are configurations as may function as product tracking devices and/or safety seals limited only to such functions. For example, an acoustic emitter 1918 as shown in FIG. 19 may serve as an anti-shoplifting feature, e.g., providing an acoustic indication that a sealed package is being opened within a store (such as by a person attempting to remove the contents for more convenient concealment and theft thereof). Such acoustic detection may be useful, for example in that an acoustic receiver may not be required to have line-of-sight. Thus, a sensor may not be visible to a prospective thief, and opening a container out of sight may not be an effective counter-measure against acoustic detection.

Now with reference collectively to FIG. 20 through FIG. 23, therein several examples are illustrated with regard to the production and/or application of acoustic emitters. Acoustic emitters may be produced through many different approaches, and are not limited; the arrangements of FIG. 20 through FIG. 23 address certain example approaches (though not necessarily the only approaches) as may be suitable for producing acoustic emitters "in situ" while encoding data therein on demand. For example, a packing tape may be provided with nonuniformities in the form of perforations, reinforcements, etc. where and when that packing tape is to be applied, e.g., using a hand-held "gun" or other device to encode data onto the tape and dispense/apply the tape for use.

Figure 20:
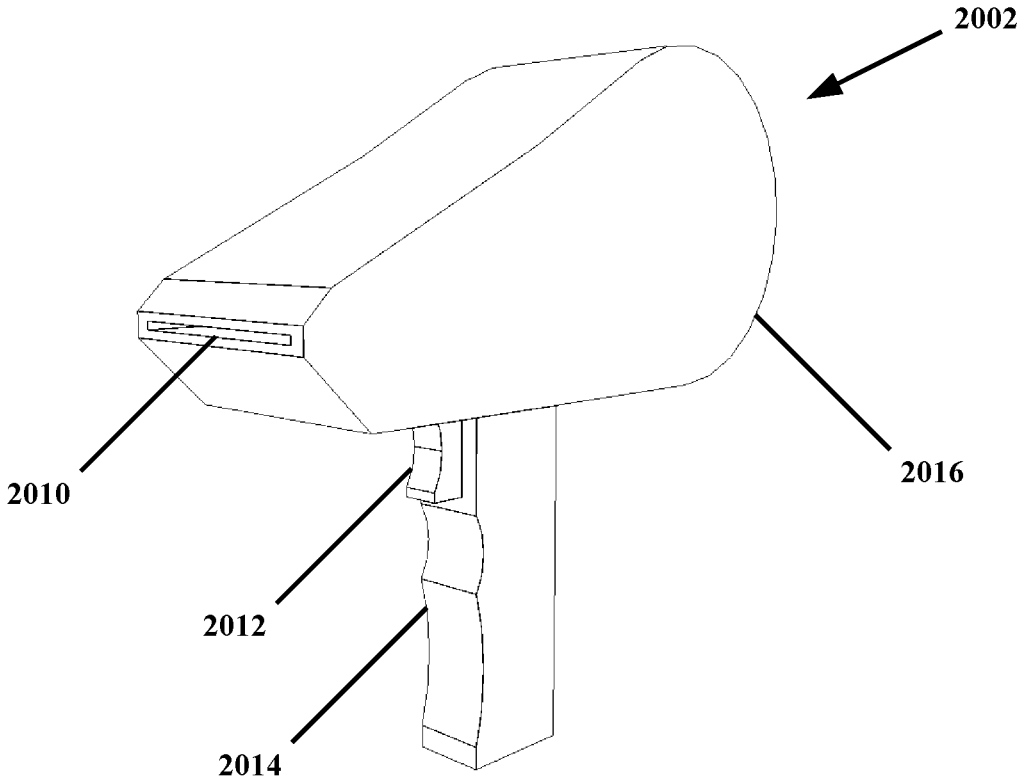
FIG. 20 shows an example dispenser as may be adapted for dispensing acoustic emitter closure tape, in perspective view.

Referring specifically to FIG. 20, therein a perspective view of an example dispenser 2002 adapted for dispensing acoustic emitter closure tape is shown. The dispenser 2002 is illustrated in a form at least somewhat similar to a "tape gun" as may be used to dispense/apply adhesive tape, though this is an example only. As may be seen the dispenser 2002 includes a housing 2016 as may enclose various internal components (not shown in FIG. 20), a grip 2014 as may serve to facilitate handling of the dispenser 2002 in use, and an activator 2012 in the form of a squeeze trigger as may operate the dispenser 2002 (e.g., encoding data, activating a mechanism to modify a tape web to carry the data, dispensing that web from the dispenser 2002, etc.) The dispenser 2002 also defines an egress 2010 through which the dispensed web may exit (e.g., for a flat web a slot as is illustrated). For simplicity no web is shown in the example of FIG. 20.

Figure 21:
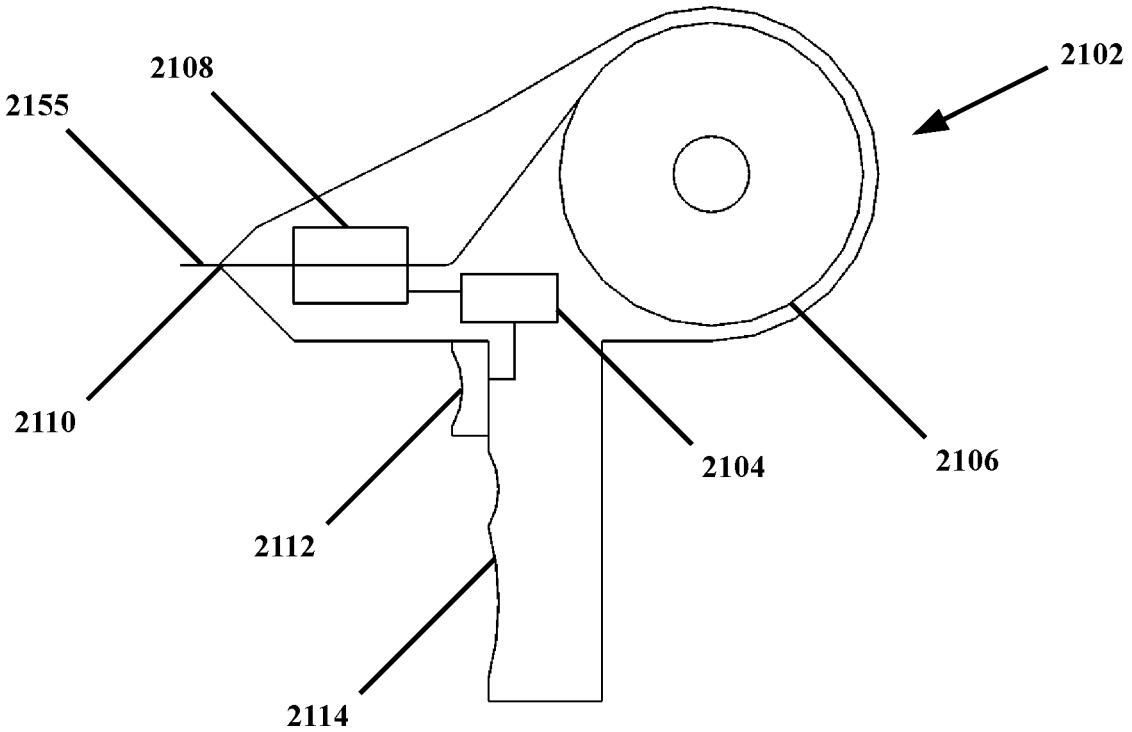
FIG. 21 shows an example dispenser as may be adapted for dispensing acoustic emitter closure tape, in schematic cross-section.

Turning now to FIG. 21, another example dispenser 2102 (as may be at least somewhat similar to the arrangement in FIG. 20) is shown in schematic view, so as to reveal certain operational features thereof. The dispenser 2102 includes a grip 2114 and activator 2112 as previously described. In addition, the view in FIG. 21 shows a web 2155 as may serve to become (or become part of) an acoustic emitter. As may be seen the web 2155 extends from a supply 2106 in the form of a roll (e.g., of paper or plastic tape, etc.), passes through a modifier 2108, and emerges from the dispenser 2102 at the egress 2110 thereof.

The dispenser 2102 includes an encoder 2104 in communication with the activator 2112. The encoder 2104 is adapted to encode information for incorporation into an acoustic emitter. For example, if a particular packing tape were to be used as an acoustic emitter with a 9-digit numerical lot number (e.g., for some product to be packed in a box), the encoder 2104 may encode that information into a form suitable for incorporation into an acoustic emitter, such as some pattern of perforations through a web 2155, a pattern of lines of adhesive or other reinforcement applied to the web 2155, etc., as may be adapted to produce an acoustic emission with nonuniformities as then may be analyzed to extract that lot number therefrom. The particulars of the encoder may vary depending on the embodiment, for example in view of what information is to be encoded, the encoding system used, the modifications to be made to the web (perforation, reinforcement, etc.), and so forth. Other arrangements, including arrangements not utilizing webs and/or dispensing guns, also may be suitable, and embodiments are not limited.

As noted the dispenser 2102 includes a modifier 2108, which as may be seen in FIG. 21 is in communication with the encoder 2104. The modifier 2108 is adapted to modify the web 2155 in some manner so as to encode information (e.g., provided by the encoder 2104) therein such that the web 2155 may function as an acoustic emitter. As with the encoder 2104, the particulars of the modifier 2108 may vary considerably. For example, a modifier 2108 may incorporate one or more punch dies adapted to produce apertures in the web 2155. Alternately, a blade may be used to cut apertures, score/weaken the web 2155, etc. A modifier 2108 may use other cutting mechanisms, such as a laser, to cut, scorch, score, etc. the web 2155. A pin, die, etc. may serve to score or weaken a web 2155 without necessarily cutting therethrough, e.g., by deforming or abrading the web. As another alternative, a modifier 2108 may apply material to a web in addition to or in place of cutting/subtracting material. For example, a print head may dispense patterns of glue, plastic, or paint onto the surface of a web 2155 (e.g., as liquids, in a molten state, as fusible solids, etc.) As yet another example, a modifier 2108 may apply some penetrating agent such as dye or liquid polymer to reinforce a web 2155, or a solvent to weaken a web 2155. Solid materials such as tape, filaments, etc. may be applied to a web 2155, to weaken, strengthen, or modify yield properties so as to facilitate nonuniform acoustic emissions therefrom. Heat-sensitive or UV sensitive material may be used as part or all of a web 2155 with a modifier 2108 using a UV light, thermal print head, etc. to alter the yield strength of the web 2155 either by weakening or strengthening (or some combination thereof) without either removing or adding to the web 2155. Furthermore, while the arrangement in FIG. 21 shows a unitary web 2155 it also may be suitable to laminate or otherwise assemble multiple layers of material into a web. In such instance nonuniformity may be introduced into the web through adding, removing, avoiding the addition of, and/or modifying various elements to the web assembly of the web. For example, patterns of reinforcing fibers may be laminated into a multilayer web. Other arrangements also may be suitable, and the types of modifications as may be carried out are not limited, nor is the modifier 2108 itself.

In addition, while the arrangement shown in FIG. 21 may be understood to both dispense a web and modify that web to function as an acoustic emitter, combining such functions in any particular device is not required. For example, certain embodiments may apply modification to a web or other closure as may already be in place, engaged with a portal. As a more concrete example, a handheld device may be adapted to utilize a print head to apply lines of reinforcing polymer onto a packing tape already in place and sealing a package, without the device necessarily dispensing the tape. (While such a non-dispensing embodiment may lack an egress for dispensing tape, an opening of at least somewhat similar appearance may be present to serve as an access port for the modifier to engage with and modify the tape. To continue the example above, an opening may be defined near the print head such that reinforcing polymer may be printed onto the tape therethrough.) As another example, a device may be adapted to brand patterns into a packing tape with a scanning laser, even after the packing tape is already in place on a package, thus selectively weakening the tape such that when the tape yields an acoustic emission is produced with data encoded therein. Likewise a safety seal may be perforated after being applied to a screw-top bottle, etc. (whether via a hand-held system or otherwise).

Figure 22:
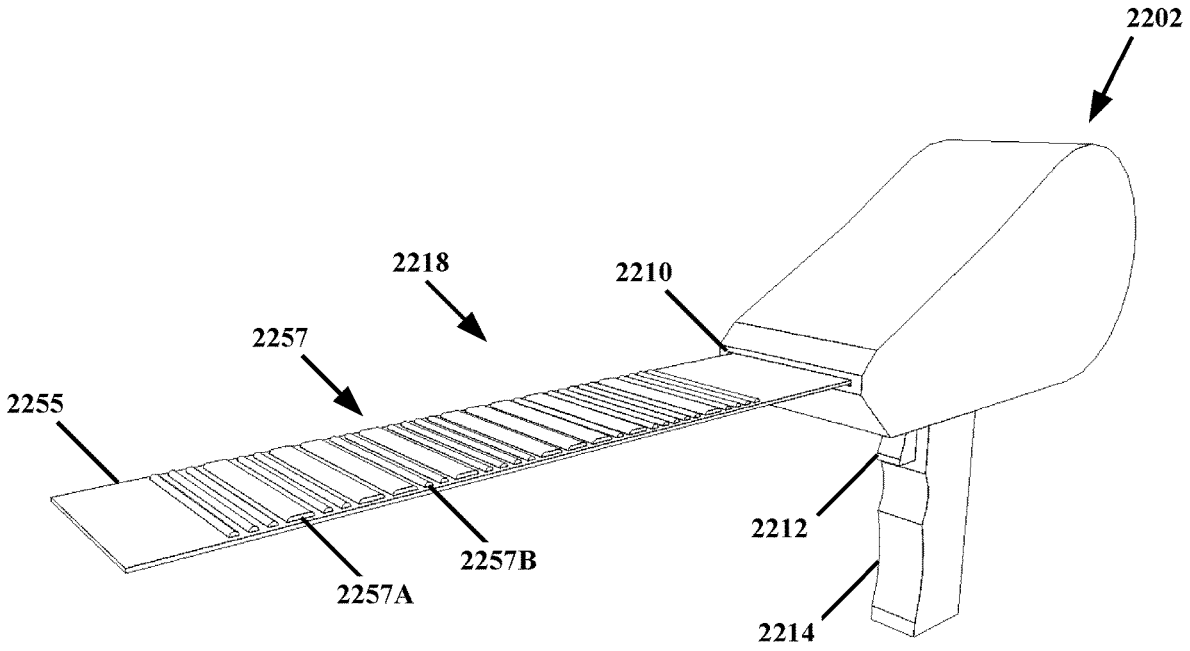
FIG. 22 shows an example dispenser as may be adapted for dispensing acoustic emitter closure tape and an example tape with reinforcements and/or adhesive thereon, in perspective view.

Moving on to FIG. 22, therein is shown a dispenser 2202 as may be adapted to dispense an acoustic emitter 2218. As may be seen the dispenser 2202 is at least somewhat similar visually to previous examples in FIG. 20 and FIG. 21, and includes a grip 2214 and an activator 2212. The dispenser 2202 also defines an egress 2210 as may pass an acoustic emitter 2218 therethrough, dispensed from the dispenser 2202.

The acoustic emitter 2218 also may be at least somewhat similar to arrangements as shown in previous examples herein, including a web 2255 with features as may be understood as reinforcements 2257 disposed thereon (though as noted below such features also may represent other structure such as adhesive). The precise nature of the reinforcements 2257 and the manner of application to the web 2255 are not limited, though for example the reinforcements may be a hot-melt material or liquid ink as may be "printed" onto the web (e.g., by a modifier as shown in FIG. 21). For such an arrangement the acoustic emitter 2257 may be made on-demand as needed, with data likewise encoded on-demand, e.g., in a portable and/or handheld dispenser 2257 (though non portable and/or non handheld dispensers also may be suitable).

As may be observed, the reinforcements 2257 exhibit different widths, e.g., reinforcement 2257A is visibly wider than reinforcement 2257B. Thus, through arranging varying patterns of reinforcements 2257 of nonuniform width data may be encoded physically within the acoustic emitter 2218, such that when the acoustic emitter 2218 yields an acoustic emission therefrom also has such data encoded acoustically therein. The web 2255 may serve as a packing tape or similar, e.g., if the underside thereof (not visible in FIG. 22) were to include an adhesive as may secure the acoustic emitter 2218 to a box, etc. (alternately, if the reinforcements 2257 themselves are or include adhesive, the reinforcements 2257 may serve to secure the web 2255).

As previously noted, the arrangement shown in FIG. 22 may be understood as at least somewhat resembling an optical barcode, and for at least certain embodiments may be optically readable (as well as being adapted to communicate data acoustically) with a barcode reader or other system. Also, it is pointed out that where certain previous examples of acoustic emitters may show nonuniformities (e.g., reinforcements, apertures, etc.) as being grouped, the arrangement of reinforcements 2257 in FIG. 22 is not so grouped. As may be observed, although the width of reinforcements 2257 varies, the spacing among reinforcements 2257 is at least approximately uniform. Grouping may in at least certain embodiments be useful, e.g., distinct groups may encode for individual letters, numbers, symbols, words, concepts, etc., with spacing therebetween (or other defining parameters) distinguishing one such encoded group from adjacent groups. However, as may be observed from FIG. 22 the grouping of reinforcements 2257 (and/or other nonuniformities) is not required.

In addition, with regard to a source for data as may be encoded, embodiments are not limited with regard to the manner by which data may be acquired for encoding, nor to the form or content thereof. Although not visible in FIG. 22, a keypad, touchscreen, or other contact interface may be included, a data port such as a USB port may be present, a wireless device such as a Bluetooth or wifi modem may be utilized, etc. Alternately, a given embodiment may be preloaded and/or pre-programmed with suitable data, e.g., the date and time (such as from an on-board clock), a device ID number, a code identifying a specific product or manufacturer, etc.; in such instance it may not be required to enter data in an ongoing manner.

Still with reference to FIG. 22, for purposes of discussion the features 2257 disposed on the web 2255 previously have been referred to as reinforcements to the web 2255. However, an alternate interpretation also may be illuminating. For example, consider an arrangement wherein the features 2257 are adhesive, e.g., the adhesive layer as may bond the tape 2218 to flaps of a packing box or other closure. That is, rather than being exposed on the surface the adhesive stripes 2257 may be on the underside of the web 2255, engaging the web 2255 with the box flaps. (In such case wherein the features 2257 are considered to be adhesive the face of the web 2255 visible in FIG. 22 may be understood as the bottom, e.g., the face to be pressed against box flaps, where for features 2257 as reinforcements the visible face of the web 2255 may be understood as the top, e.g., the face exposed when the tape is in place.) It is noted that in such instance such adhesive stripes 2257 may perform at least two functions, holding the portal closed and also encoding data for emission in acoustic form. Thus, it should be understood that structure as may encode data is not limited only to encoding data, and may perform other functions. Such "double duty" arrangements may be suitable and are not excluded, but also are not required.

To continue the example of patterned adhesive stripes 2257, depending on the particulars of the embodiment a nonuniform acoustic emission may be produced when the web 2257 is caused to yield by being torn or cut, and/or by some other yield mode such as when the web 2257 is peeled away from a surface (such as box flaps). As noted previously various acoustic emitters may yield in various modes, without limit; and as may be understood considering an arrangement of adhesive stripes 2257 with regard to FIG. 22, a given embodiment may produce a suitable acoustic emission through yielding in more than one mode (e.g., a nonuniform sound produced as patterned adhesive tape is peeled away, and/or a nonuniform sound produced if instead the same patterned adhesive tape were cut or torn).

Further, the consideration of nonuniform adhesive with regard to FIG. 22 may be seen to illustrate certain additional features. First, as noted an acoustic emission may be produced as a closure such as is shown in FIG. 22 is peeled away from a portal. It should also be understood that, if the adhesive stripes 2257 were already present on the web 2255, then an acoustic emission also might be produced (with data encoded therein) as the tape 2218 is dispensed, e.g., as a length of tape is peeled away from a roll thereof (Such action may for example take place within the dispenser 2202, though peeling of tape from a roll is not illustrated in FIG. 22.) Thus, it should be understood that acoustic emissions may be produced as a closure is made/dispensed, in addition to or instead of as a closure releases a portal.

For example, a roll of tape may be pre-printed (e.g., as the tape is manufactured) with patterned adhesive on one side thereof, so that a nonuniform acoustic emission is produced as the tape is dispensed. That adhesive then may hold the tape in place and subsequently produce an acoustic emission as the tape is cut, peeled, etc. Alternately, adhesive may be applied to either the same side of the tape (so as to produce two overlapping adhesive patterns, and thus at least potentially two overlapping encoded acoustic emissions) or to the opposite side (such that one acoustic emission is produced as tape is dispensed/applied, and a second acoustic emission is produced as that tape is peeled, cut, etc.). As yet another alternative, adhesive may be patterned (e.g., in advance) to produce an acoustic emission as tape (or some other closure) is dispensed, with that tape also being patterned with reinforcements, apertures, etc. as or after the tape is dispensed. Thus it should be understood that embodiments are not limited to only one type of modification, or to only one time/condition of acoustic emission.

As another feature, with regard to an example arrangement wherein patterns encoded into the adhesive of an adhesive tape, it is pointed out that such an arrangement may be understood to structurally encode data in that tape, even though the adhesive patterning itself may neither weaken nor reinforce the tape. That is, the tape may not be any weaker for the adhesive being in a particular pattern, nor any stronger (though strengthening or weakening is not excluded). Thus it should be understood that although weakening and/or strengthening a tape web is presented in at least certain examples herein, this is illustrative and is not limiting. It is not required that a web or other component must be either weakened or strengthened generally, nor must encoded data necessarily be encoded through such weakening or strengthening, nor must any changes as may encode data (or otherwise) necessarily involve weakening or strengthening. While apertures, scoring, printed polymers, transverse fibers, etc. for strengthening and/or weakening may be suitable for encoding data in certain embodiments, such arrangements are not necessarily required for all embodiments, and other arrangements may be suitable.

Figure 23:
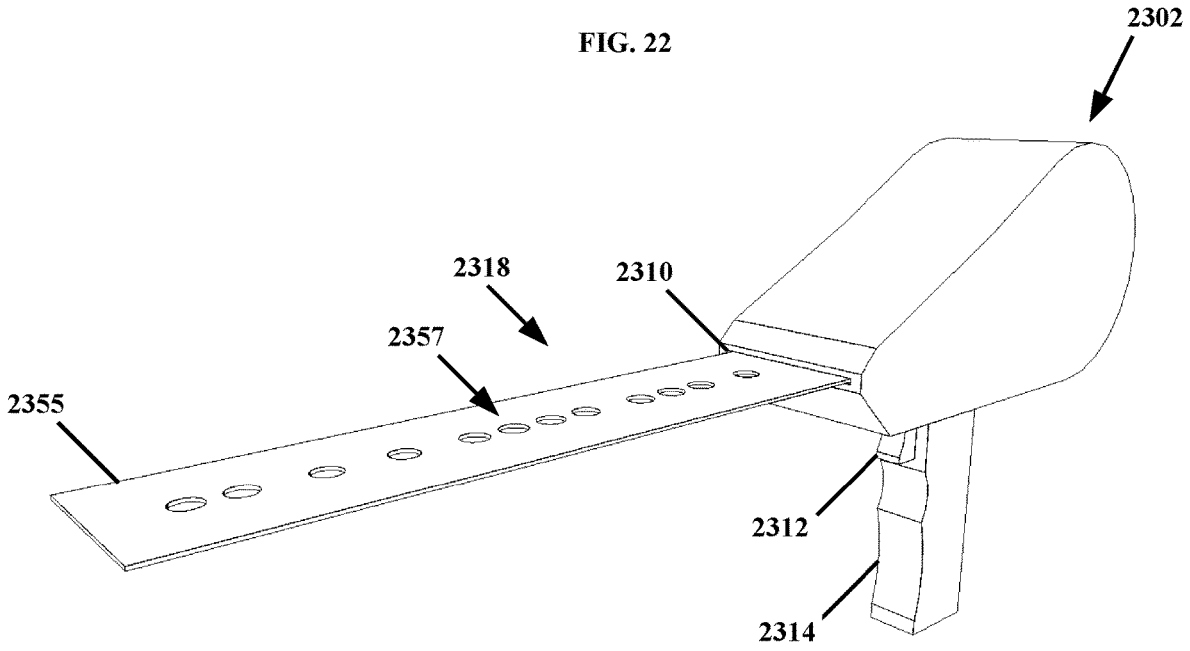
FIG. 23 shows an example dispenser as may be adapted for dispensing acoustic emitter closure tape and an example tape with apertures therethrough, in perspective view.

Turning to FIG. 23, another example dispenser 2302 is shown as may be adapted to dispense an acoustic emitter 2318. The dispenser 2302 includes a grip 2314 and an activator 2312 and defines an egress 2310 as may pass an acoustic emitter 2357 therethrough. As may be seen, the acoustic emitter 2357 includes a web 2355 with apertures 2357 defined therethrough. The manner by which apertures 2357 may be defined again is not limited, though e.g., a punch die, blade, laser cutter, etc. may produce apertures 2357 in the web 2355 on an as-needed basis. (Material from the web 2357 as may be so removed may be stored within the dispenser 2302, expelled therefrom, etc., without limit.)

As may be observed, the apertures 2357 appear to be at least approximately similar to one another, with spacing among apertures 2357 being visibly nonuniform. Such an arrangement may be useful, e.g., in that a single size/shape of aperture 2357 may be punched using a simple mechanism such as a single punch die. However, in other embodiments it may be suitable to enable the production of differing apertures, e.g., with multiple dies, a variable-shape cutting system (such as a blade, hot wire, or laser), etc. In addition, it is noted that although the apertures 2357 in FIG. 23 are presented as distinct and spaced-apart circles (or at least approximations thereof), two or more overlapping circular apertures may be understood to cooperate to define one elongated aperture, and thus a single punch (or similar) may nevertheless produce apertures of varying size and/or shape for certain embodiments.

Figure 24:
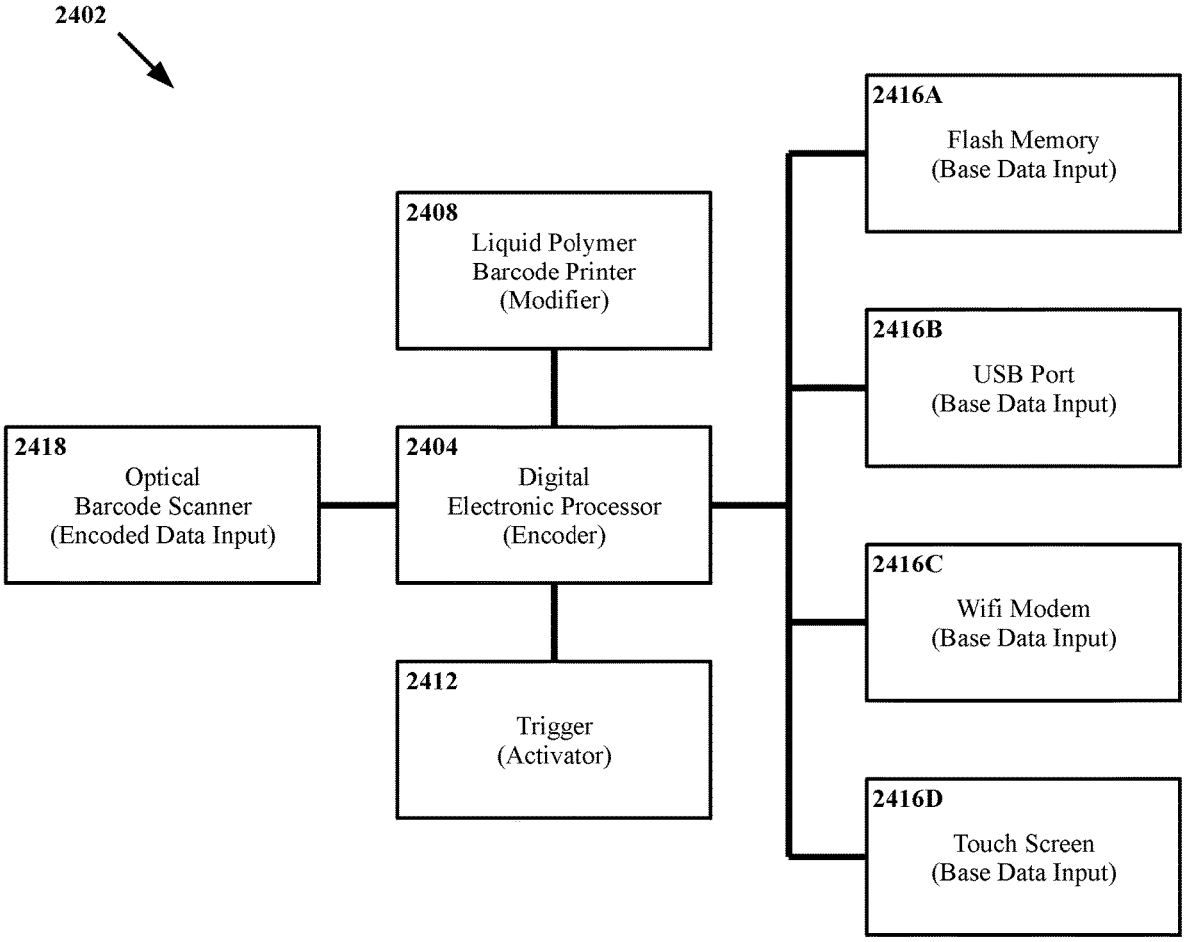
FIG. 24 shows a schematic view of elements an example dispenser as may be adapted for dispensing acoustic emitter closure tape.

Now with reference to FIG. 24, therein is shown a schematic view of an example dispenser 2402 showing certain active elements thereof as may be present. For illustrative purposes, elements as shown are presented as specific mechanisms, however this is an example only and is not limiting. As may be seen, in the dispenser 2402 an encoder in the form of a digital processor 2404 is present, as may be adapted to encode base data into encoded data (and/or vice versa). A modifier in the form of a liquid polymer barcode printer 2408 (e.g., as may apply a curable or hot-melt liquid polymer to a paper web so as to penetrate therein or remain on a surface thereof, increasing yield strength in nonuniform arrangement) is present. The liquid polymer barcode printer 2408 is in communication with the digital processor 2404, such that encoded data (e.g., as encoded from base data by the digital processor 2404) may be communicated to the liquid polymer barcode printer 2408, enabling the liquid polymer barcode printer 2408 to print the encoded data onto a paper web (or other material) to produce an acoustic emitter. An activator in the form of a trigger 2412 is in communication with the digital electronic processor 2404, e.g., such that squeezing the trigger 2412 causes the digital electronic processor 2404 to encode data, the liquid polymer barcode printer 2408 to feed web and print liquid polymer thereon, etc.

The dispenser 2402 as shown also includes four base data inputs in the form of a flash memory 2416A, a USB port 2416B, a wifi modem 2416C, and a touch screen 2416D, respectively, in communication with the electronic processor 2404. Any one or more such base data input may serve to communicate base data to the electronic processor 2404 so as to enable the electronic processor 2404 to encode encoded data therewith. Not all embodiments necessarily will have all such base data inputs 2416A, 2416B, 2416C, and 2416D as shown; embodiments may have more or fewer than is show in FIG. 24, may have different base data inputs, etc. In addition, it is noted that certain base data inputs—including but not limited to the flash memory 2416A, USB port 2416B, wifi modem 2416C, and touch screen 2416D as shown—may operate as inputs and/or outputs for base data, encoded data, and/or other data. For example, an update to the instructions by which the electronic processor 2404 encodes base data to produce encoded data may be delivered via a USB port 2416B, encoded data (and/or base data used to produce that encoded data) may be stored in the flash memory 2416A, base data under consideration may be displayed graphically on the touch screen 2416D as the electronic processor 2404 produces encoded data therefrom, a signal that the dispenser 2402 is low on paper web, liquid polymer, etc. may be sent via the wifi modem 2416C, etc. Also, other interface mechanisms for input and/or output may be suitable, including but not limited to mechanical keypads, physical controls such as buttons, dials, switches, etc., a microphone for voice inputs, a speaker for producing an approximation of the anticipated acoustic emission (e.g., to confirm that data is entered/encoded as intended), and so forth. Such mechanisms may vary widely, for example at least in principle a camera may be used to acquire an image of a person packaging a product, with information about the face of the user (e.g., geometry of key points on the user's face) being encoded and applied to a closure (for instance, as potentially difficult-to-spoof indications that the product is valid, etc.). Likewise signatures and/or other types of information (whether complete or abstracted, as with the previous example of face geometry) in addition to or instead of letters and numbers may be utilized as base data (and encoded and modified into a closure, for production of acoustic emissions). Although certain examples herein refer to relatively simple base data such as simple number series (e.g., several consecutive prime numbers) the size and/or complexity of data sets is not limited. It may for example be possible for certain forms of encoding and/or closure modification to enable the instilling of large data sets such as a full (possibly encoded) graphical image of a user. Such large data sets may be possible and may in at least some instances be useful but are not required.

Other arrangements also may be suitable.

Still with reference to FIG. 24, the dispenser 2402 as shown includes an encoded data input in the form of an optical barcode scanner 2418. As noted previously, in at least certain instances acoustic emitters may exhibit visible traces of nonuniformities as may be considered acoustic barcodes, and those visible traces may be readable optically (or through tactile sensing, infrared, etc.). The arrangement in FIG. 24 presents an example of such, e.g., liquid polymer as printed on a paper web to produce nonuniformities in yield strength/acoustic emission also may be visible as transverse lines of varying width/spacing/etc., and the optical barcode scanner 2418 may be adapted to optically detect such lines. Thus, the dispenser 2402 as shown may both apply an acoustic barcode and read such a barcode optically.

Active components are not limited to those shown in FIG. 24. For example, a roll mount for a paper web (or another closure supplier) may be actuated, e.g., such that the liquid polymer barcode printer 2408 may drive the feeding of paper web therefrom (in addition to or instead of drawing paper web into the liquid polymer barcode printer 2408 itself. Likewise, additional components may be present, e.g., a power supply is not shown although at least certain elements shown in FIG. 24 may be electrical (though elements are not necessarily required to be electrical).

In addition, while elements of the dispenser 2402 are shown together in FIG. 24, it is noted that not all embodiments will or must have all elements in a single device or system. For example, it may be suitable to utilize a smart phone or other electronic device to provide a digital electronic processor 2404, optical barcode scanner 2418 (e.g., a camera of the smart phone) and flash memory 2416A, USB port 2416B, wife modem 2416C, and touch screen 2416D, with a liquid polymer printer 2408 and paper web roll (not shown in FIG. 24) in some device that may physically engage with the smart phone, communicate wirelessly therewith, etc. (Depending on the particular of the embodiment, a physical button or touch screen icon may serve as the activator instead of or in addition to a mechanical trigger.) Other arrangements also may be suitable.

As noted, the arrangement in FIG. 24 is a specific example presented for illustrative purposes. In practice not all elements shown necessarily will or must be present in a given embodiment, elements may vary, additional/different elements may be present, etc. So long as the necessary functionality may be carried out, the particulars of a given dispenser are not limited. Typically though not necessarily, a "bare bones" dispenser may be understood as utilizing some means for obtaining base data, some means for producing encoded data using that base data, and some means for instilling that encoded data into a closure (such that the closure may produce a suitable acoustic emission). With reference to FIG. 24 such roles may be understood to be carried out by 2416A through 2416B for supplying base data, 2404 for producing encoded data, and 2408 for instilling that data in closures. However, even such a simplified arrangement may be further reduced in at least some embodiments. For example, if encoded data were already available (e.g., the original information already exists in a form as may be readily punched as holes, applied as polymer strips, etc.), obtaining base data as such may not be necessary (or alternately, in such instance the base data and encoded data may be considered to be the same). Thus, while a specific example may be understood from FIG. 24, many variations also may be suitable.

Now with reference to FIG. 25 through FIG. 33 collectively, certain example methods are presented as may be suitable in determining use and validity through acoustic emissions. Examples illustrated and described include the producing of closures as may serve as acoustic emitters, the configuring of a dispenser for producing closures as may serve as acoustic emitters, and the configuring of a writer for applying acoustic emission functionality to closures as may already exist. Other arrangements also may be suitable, and these examples are not limiting.

Figure 25:
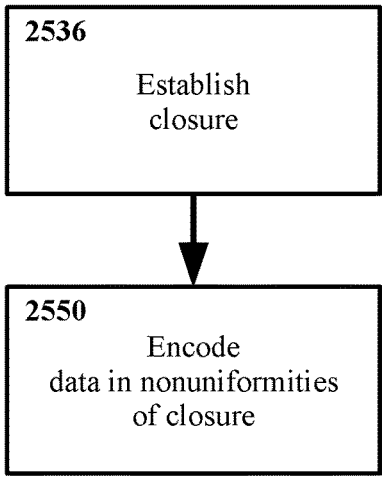
FIG. 25 shows an example method for providing acoustic emission communication capabilities, in flow-chart form.

In FIG. 25, an example method for providing acoustic emission communication capabilities is shown. A closure is established 2536. Such a closure may include (but is not limited to) various packing tapes, safety seals, other webs, etc., as may serve to secure some portal such as box flaps, an envelope, a screw cap, a flip top, etc. in a closed state while the closure is engaged therewith. Various examples (though not necessarily the only examples) of closures have been described previously herein. Continuing in FIG. 25, data is encoded 2550 into nonuniformities of the closure. For example, a web may be punched, scored, etched, heat-treated, etc. in a controlled configuration to weaken certain parts thereof, and/or a web may be UV cured, heat treated, impregnated with a penetrating or surface-resident ink, overlaid with a hot-melt polymer, incorporated with reinforcing fibers or strips, etc. in a controlled configuration to strengthen certain parts thereof.

The arrangement in FIG. 25 may be understood as at least somewhat abstracted. However, attention is drawn to several points. First, for explanatory purposes it may be understood that the method shown (and certain other example methods herein) may be understood colloquially (and without limitation) as: "make or get something to close an opening, and define or change the structure of that closure so as to produce information-carrying sounds when closure is torn, cut, removed, or otherwise loosed". Second, the abstraction in the arrangement of FIG. 25 may be understood to emphasize a degree of variation in possible embodiments. For example, the type of closure, the type of portal, the manner in which the closure engages the portal, the type of nonuniformities introduced, the manner of introducing those nonuniformities, etc. are no limited and may vary widely.

Also, although certain examples herein have referred to "modifying" an existing closure, e.g., punching holes in adhesive tape, in other embodiments it may be suitable to introduce uniformities into a closure as that closure is being produced, rather than modifying the closure after. For example, to again refer to an adhesive tape a pattern of transverse reinforcing fibers may be laminated in place as the adhesive is applied to the base (e.g., paper) web, the adhesive may be applied in patterns such that the bond strength or tear strength of the tape is nonuniform, etc. (Given such an arrangement, steps 2536 and 2550 in FIG. 25 may be combined and performed together.) As another example, a ribbon of hot-melt polymer may be applied directly to flaps of a box in patterns so as to exhibit nonuniform yield strength and produce a nonuniform acoustic emission upon yielding. In such arrangement the closure at least arguably may not even exist until applied (e.g., being a bulk tank of hot melt polymer until dispensed), and information is encoded into the closure as part of the creation and application of that closure.

In a strict philosophical sense it may be debatable as to whether incorporating such nonuniformities is literally a "modification" as such. However, in practice it may be reasonable to apply the term nevertheless, e.g., a "modified adhesive tape" may not necessarily imply that the tape was made first and then modified, but rather that the tape is (and was fabricated to be) different than might otherwise be the case (e.g., the tape has structural nonuniformities as may not be otherwise typical of such tape). Thus, terms such as "modifier" and "modified" may be understood herein as encompassing nonuniformities introduced regardless of relative timing, e.g., before, during, or after a closure is produced and/or applied.

Figure 26:
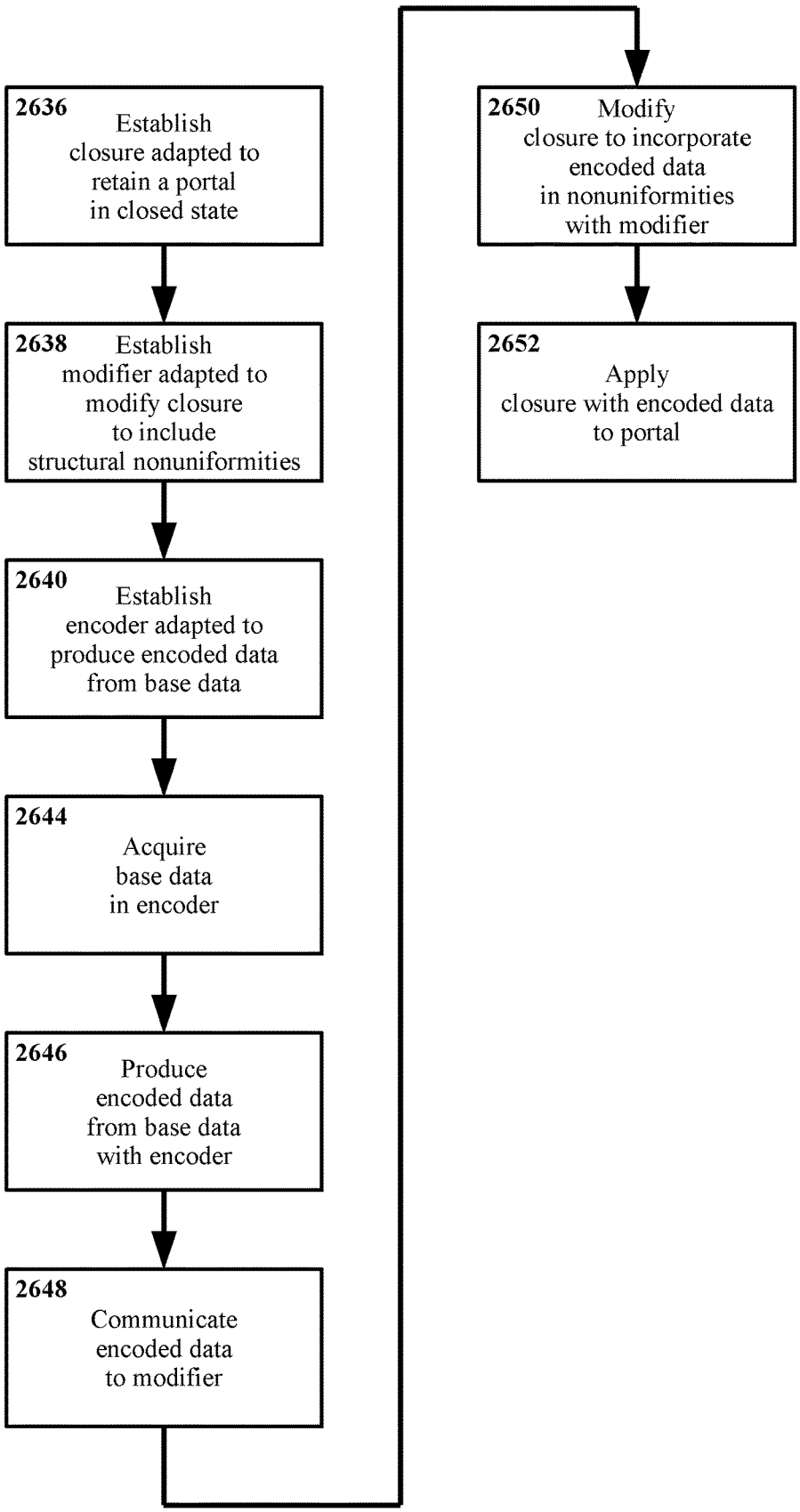
FIG. 26 shows another example method for providing acoustic emission communication capabilities, in flow-chart form.

Moving on to FIG. 26 another example method is presented as may be at least somewhat similar to that in FIG. 25, but with further details. A closure adapted to retain a portal in a closed state is established 2636, e.g., manufactured, acquired, etc. A closure modifier is established 2638, that closure modifier being adapted to modify the closure so that the closure includes structural nonuniformities. For example, a hot-wire mechanism may be disposed in proximity with a spool of plastic film, so that the film may be dispensed as a safety seal for a bottle and the hot-wire mechanism may cut patterns of holes or lines through the plastic film. Also, an encoder is established 2640 adapted to produce encoded data from base data. To continue the example above, a digital processing chip may be connected with the hot-wire mechanism so as to communicate therewith.

Base data is acquired 2644 in the encoder. The manner by which the base data may be so acquired is not limited. For instance base data may be read from a hard drive or flash drive, input from a keypad, etc. Typically though not necessarily, the base data may be some form of information as may be relevant to the portal being secured, for example for a safety seal the base data may include a lot number, packaging date, packaging machine number, authentication code for validating a product as legitimate, etc. Thus base data may for example be plain text alphanumeric strings in at least certain embodiments, though other arrangements may be suitable.

Encoded data is produced 2646 within the encoder from the base data. For example if the acoustic emission is to be produced by cutting a series of holes in a safety seal, plain text (or other base data) may be converted into variations in size, position, spacing, etc. of the various holes to be cut. Colloquially, the encoded data may in some sense be understood to be "what the modifier will write" on the closure (or alternately, instructions for the modifier to execute to produce appropriate changes to the closure, etc.). The encoded data is communicated 2648 to the modifier. The modifier then modifies 2650 the closure to incorporate the encoded data in nonuniformities (to continue the example above, the holes are hot-wire cut into the material of the safety seal). The closure is also applied 2652 to the portal, e.g., plastic film with suitable holes therein may be secured around the neck of a bottle.

It should be understood that the order and/or presence of certain steps may differ for various embodiments. For example, it may be suitable to apply a closure first and then incorporate nonuniformities, e.g., to secure a safety seal in place and then cut holes therein, in which case steps 2650 and 2652 as shown in FIG. 26 may be reversed.

Figure 27:
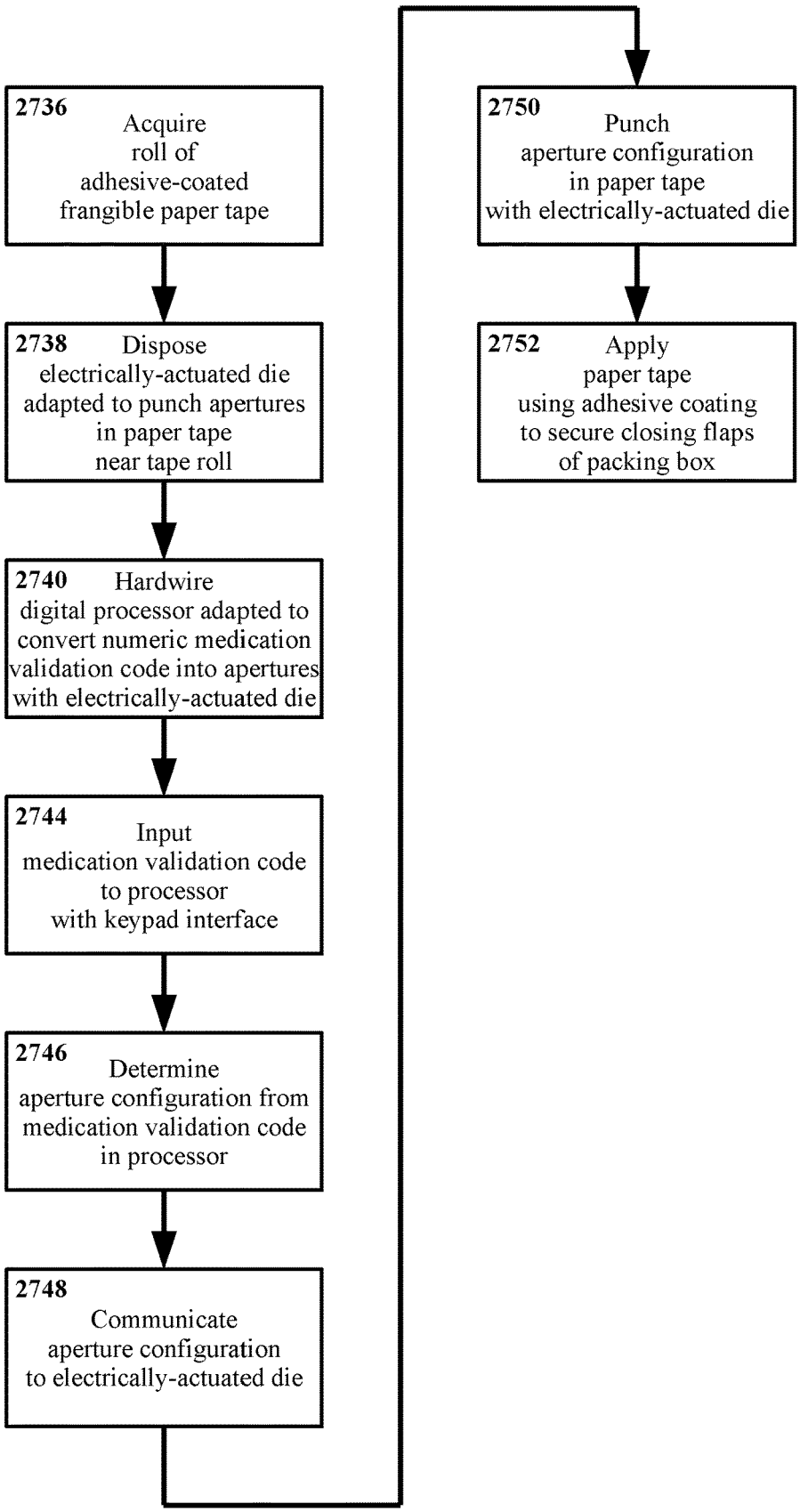
FIG. 27 shows yet another example method for providing acoustic emission communication capabilities, in flow-chart form.

Now with reference to FIG. 27, therein a relatively concrete example method is shown for illustrative purposes, as may in some manner resemble the arrangement in FIG. 26. In FIG. 27 a roll of adhesive-coated, frangible paper tape is acquired 2736. An electrically-actuated die adapted to punch apertures in such paper tape is disposed 2738 near the tape roll. A digital processor is hardwired 2740 to the electrically-actuated die, the processor being adapted to convert a numeric code for validating medication (e.g., as being authentic/legal/inspected, etc. rather than a counterfeit product) into a series of apertures in the adhesive tape.

The medication validation code is input 2734 into the processor using a keypad interface. For example, a user may manually type keys to inter the proper number for use by the processor. Such manual entry, while not required, nevertheless is not prohibited, and may be useful in at least certain instances. While large scale packaging and shipping of a commercially available medication may utilize automated systems, etc., clinical studies, test samples, early marketing shipments, etc. involving medications may be boxed and sealed manually.

Still with reference to FIG. 27, the aperture configuration (as determined 2746 previously) is communicated 2748 from the processor to the electrically actuated die. The electrically actuated die then punches 2750 the specified aperture configuration into the paper tape, e.g. as the tape is being dispensed from the roll and passing by/through the die mechanism. The punched paper tape is adhered 2752 using the adhesive coating thereon to secure the closing flaps of a packing box (e.g., a box for shipping or storing medication).

Figure 28:
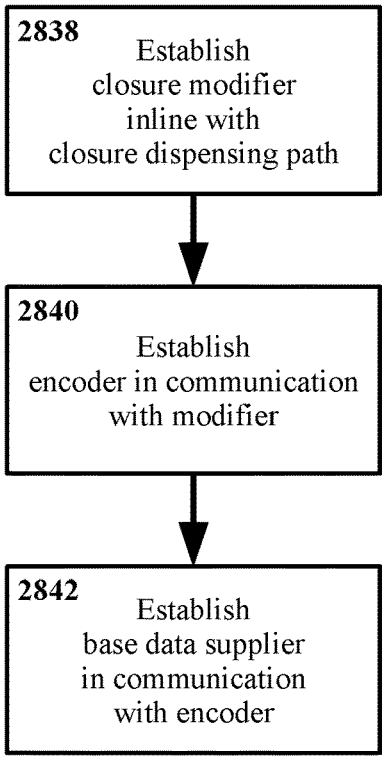
FIG. 28 shows an example method for providing a device and/or system for carrying out certain tasks as may relate to the encoding/application of closures, in flow chart form.

Moving on to FIG. 28, as noted previously (e.g., as shown in FIG. 21) it may be suitable to provide a well-defined device and/or system for carrying out certain tasks relating to the encoding/application of closures. The arrangement in FIG. 28 presents an example method for providing such a device and/or system. A closure modifier is established 2838, the closure modifier being inline with a dispensing path for a closure. An encoder also is established 2840, the encoder being in communication with the modifier. Further, a base data supplier is established 2842 in communication with the encoder. A device/system as provided via an arrangement shown in FIG. 28 may for example be adapted to supply base data to an encoder, such that the encoder may produce encoded data and communicate that encoded data to a closure modifier, so that the closure modifier in turn may modify a closure to exhibit suitable nonuniformities as may lead to the production of a nonuniform acoustic emission.

Figure 29:
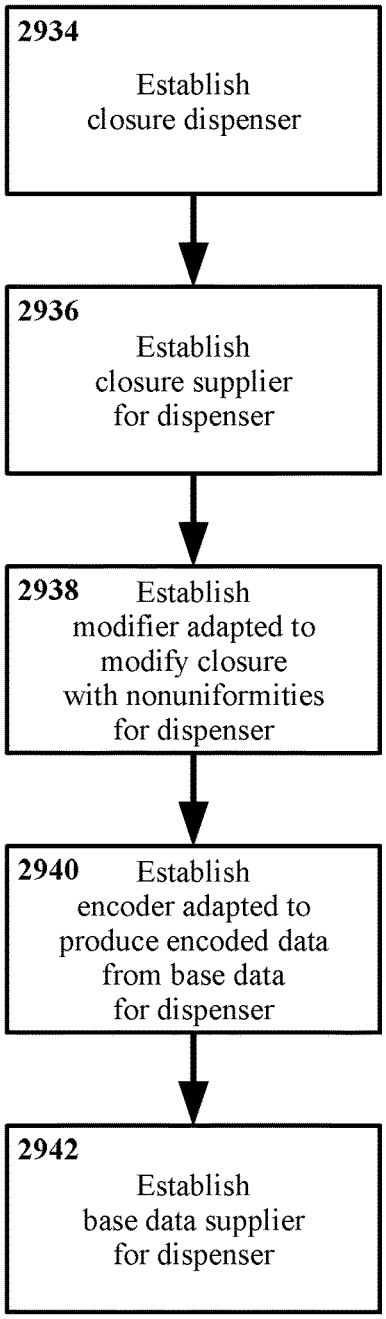
FIG. 29 shows another example method for providing a device and/or system for carrying out certain tasks as may relate to the encoding/application of closures, in flow chart form.

In FIG. 29 another example of providing a device/system, with additional detail relating thereto. A closure dispenser (e.g., a device or system providing closures adapted produce suitable acoustic emissions) is established 2934. The particulars of the dispenser are not limited and may vary considerably. In certain instances it may be useful for a dispenser to be a portable and/or handheld device, such as a tape gun or similar. However in other instances a dispenser may be a piece of stationary equipment on a production line, etc. Likewise, while dispensers may be self-contained such as the aforementioned tape gun (e.g., most/all components are in a single device dedicated to dispensing closures), dispensers also may be integrated into other devices (e.g., being part of a larger packaging machine) and/or may be spread among multiple devices (for example, a processor that determines encoded data may be in a separate device from a modifier that applies that encoded data to closures). Other variations also may be suitable.

A closure supplier is established 2936 for the dispenser. Typically though not necessarily the closure supplier may be in, on, or otherwise part of the dispenser, for example a powered roll or other feed mechanism for supplying adhesive tape, shrink film, hot-melt polymer, etc. may be part of the dispenser itself. (For use the base material(s) for the closure may themselves also be provided, but those materials may not necessarily be considered as part of the dispenser itself, even for embodiments where the base materials are disposed in or on the dispenser.) A modifier is established 2938 for the dispenser (again, typically though not necessarily in the dispenser), adapted to modify closures with nonuniformities. An encoder also is established 2940 for the dispenser, adapted to produce encoded data from base data, and a base data supplier is established 2942 for the dispenser.

Figure 30:
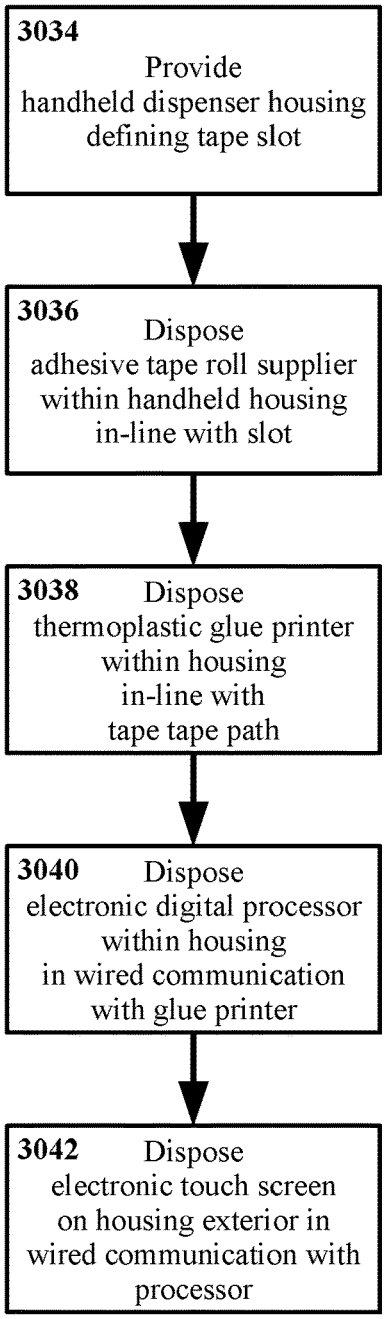
FIG. 30 shows yet another example method for providing a device and/or system for carrying out certain tasks as may relate to the encoding/application of closures, in flow chart form.

FIG. 30 presents an example as may in at least some degree resemble that in FIG. 29, but with reference to specific actions and mechanisms for explanatory purposes. In the arrangement of FIG. 30 a handheld dispenser housing is provided 3034, with a slot for passing tape defined therein. For example, a housing may be injection molded from plastic in a form adapted to be conveniently gripped and provided space therein for the various other elements as may make up a dispenser. (For illustrative purposes, it is noted that the arrangement in FIG. 20, though not limiting, may correspond with such a housing.)

An adhesive tape roll supplier is disposed 3036 within the housing, such that tape from a roll engaged with the supplier may pass through the tape slot to exit the housing. The tape roll supplier may for example be a motorized reel adapted to drive the roll so as to dispense tape (e.g., at a controlled rate, with pauses for modification, etc.), but alternately may be a simple inert pin onto which a roll of tape may be fitted, etc.

A thermoplastic glue printer is disposed 3038 within the housing, being disposed 3038 therein in a configuration as to enable the thermoplastic glue printer to apply patterns of glue to tape from the dispenser in response to encoded data provided to the printer. For example, the thermoplastic glue printer may define an aperture to accept tape passing therethrough, may be adjacent the dispensing path for tape, etc. The thermoplastic glue printer may for example be of a sort using a heated nozzle or head mounted to an actuated mechanism adapted to translate the head transversely across the tape so as to produce patterns of lines thereon (e.g., as may be similar to the example shown in FIG. 22) in some suitable material, such as poly ethylene-vinyl acetate (PEVA), though this is not limiting. Such lines may serve to reinforce a frangible tape, so that acoustic emissions from the yielding of that tape are nonuniform and may carry information therein (as previously described herein). However, other arrangements also may be suitable.

An electronic digital processor is provided 3040 within the housing, being put in wired communication with the glue printer so as to provide encoded data thereto. The processor is adapted to accept base data, e.g., plaintext alphanumeric messages such as lot numbers, product names, packaging dates, etc., (though such examples are not limiting) and convert that base data into encoded data suitable for the thermoplastic glue printer, e.g., translating plaintext into a series of transverse lines of various widths, spacings, etc. and/or into instructions for the printer to print the same.

In addition, an electronic touch screen is provided 3042 on the housing exterior and in wired communication with the processor, such that base data may be entered via the touch screen for communication to the processor. For example, the touch screen may display a graphical alphanumeric keypad, graphical buttons for various types of information to encode (e.g., a button for an ID code of the person performing the packaging on one button, a button for the identity of the contents being processed, etc.), and so forth. Thus a user may conveniently enter base data as desired, for conversion into encoded data and application to packing tape.

Figure 31:
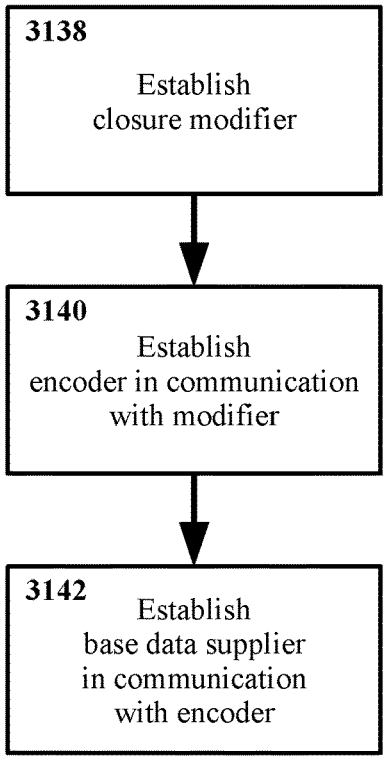
FIG. 31 shows an example method for providing a device and/or system for carrying out certain tasks as may relate to the encoding of closures as may already be applied, in flow chart form.

Turning to FIG. 31, as noted previously herein embodiments are not limited with regard to whether encoded information is instilled in a closure before, during, or after the closure is applied. The arrangement in FIG. 31 provides an example for providing a system or mechanism adapted to apply modifications to a closure as may already exist and/or be in place, e.g., modifying packaging tape already in place securing the closure flaps of a box. In the example, a closure modifier is established 3138. For example, a mechanism for weakening or removing portions of a closure, and/or for adding or strengthening portions, is made available. An encoder is established 3140, such as (but not limited to) an electronic processor adapted to convert base data to encoded data, the encoder being in communication with the closure modifier. Additionally, a base data supplier is established 3142 in communication with the encoder, and adapted to supply base data to the encoder. Closure modifiers, encoders, and base data suppliers have been previously described herein, and such elements as may be employed for modifying closures after creation/application may at least in some degree resemble closure modifiers, encoders, and base data suppliers as may be employed for modifying closures before application.

Figure 32:
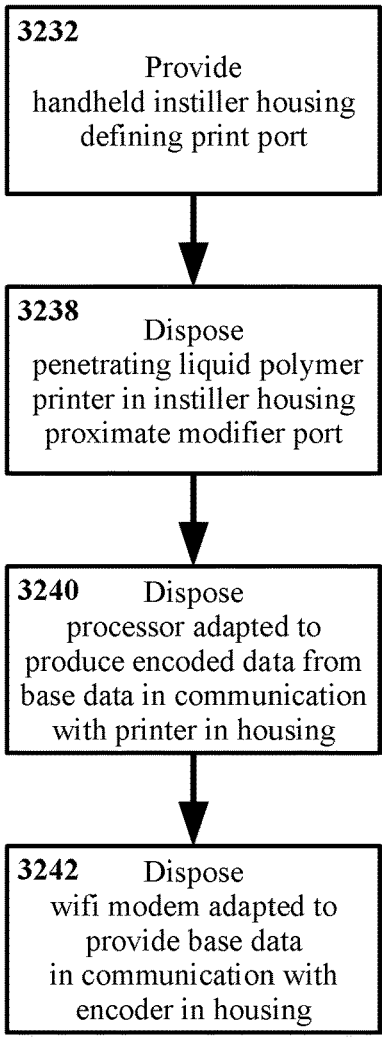
FIG. 32 shows another example method for providing a device and/or system for carrying out certain tasks as may relate to the encoding of closures as may already be applied, in flow chart form.

Moving on to FIG. 32, another example is presented at least somewhat similar to that in FIG. 31, but addressing a concrete embodiment for explanatory purposes. A handheld instiller housing is provided 3232, the housing having a print port defined therein. The term "instiller" is used with regard to FIG. 32 in a sense at least somewhat similar to "dispenser" in certain other examples herein, e.g., the instiller is a device or system as may instill structural nonuniformities into a closure, such that the closure may produce nonuniformities in acoustic emissions upon yielding. Where a dispenser may be understood to dispense a closure (and or create a closure, etc.) with suitable structural nonuniformities, an instiller may not provide a closure in itself but may nevertheless instill structural nonuniformities in an existing closure. The terms are used descriptively herein, and it should be understood that some overlap may be present therebetween. For example, at least in principle a paper adhesive tape may be argued to be a pre-existing closure, thus at least arguably a dispenser for such paper adhesive tape might be referred to as an instiller (in addition to or instead of a dispenser). A distinction between dispensers and instillers is presented herein for illustrative purposes, but (since as noted a sharp distinction may not be clear for all embodiments) such distinction is not necessarily limiting.

Continuing in FIG. 32 a penetrating liquid polymer printer is disposed 3238 in the instiller housing, the printer being disposed proximate the modifier port. For example, considering a printer as may be mechanically similar to an inkjet printer the print head therefor may be aligned with and/or may extend at least partially through the print port. In such instance when the instiller is pressed against a paper tape to be modified, the print head may dispose patterns of liquid polymer to penetrate the paper tape and cure (e.g., from heat, UV light, ambient oxygen, etc.), the cured polymer increasing the yield strength of the paper tape in a pattern such that a nonuniform acoustic emission may be produced as the tape (at some later point) yields. However, this is an example only and other arrangements may be suitable.

A processor is disposed 3240 in the instiller housing, the processor being adapted to produce encoded data from base data, and being in communication with the penetrating liquid polymer printer. A wifi modem also is disposed 3242 in the instiller housing, the wifi modem being in communication with the processor and adapted to provide base data thereto. For example, suitable base information may be present in (or may be received by) a phone, laptop computer, desktop computer, etc., then communicated wirelessly to the instiller via the wifi modem. Such an arrangement may be useful in various circumstances, for example a central computer may provide and coordinate base data to one or to many instillers (and/or dispensers) throughout an area, allowing "cordless" functionality while still keeping base data handling centralized. (Alternately, a central computer also may serve as an encoder, supplying encoded data via wifi, e.g., so that only encrypted validation data is broadcast rather than plaintext base data for security reasons.) Other arrangements also may be suitable, however.

Figure 33:
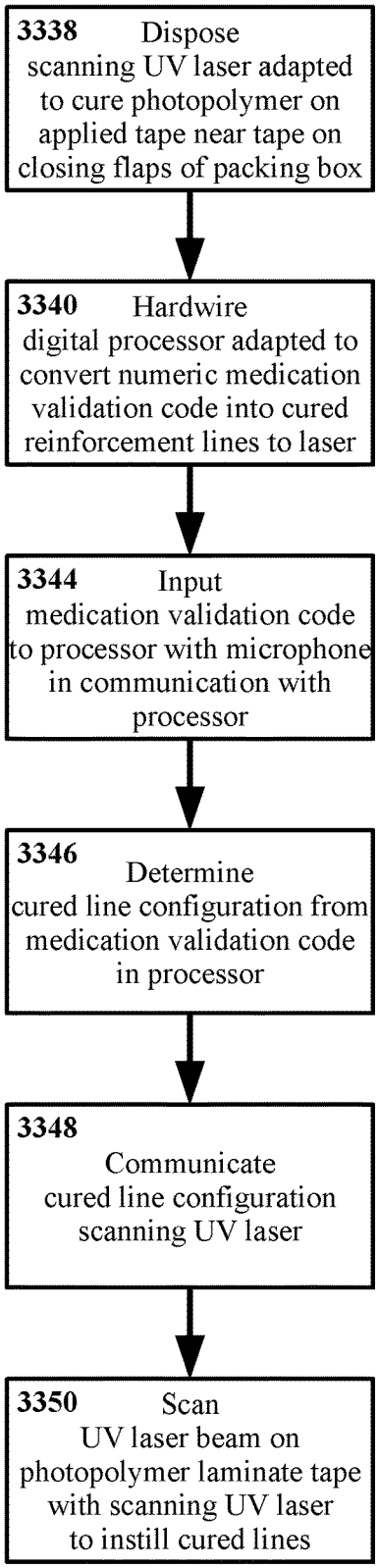
FIG. 33 shows an example method for providing acoustic emission communication capabilities for a closure as may already been engaged with a portal, in flow-chart form.

Now with reference to FIG. 33, another example method for providing acoustic emission communication capabilities is shown, at least somewhat similar to certain previous examples, e.g., FIG. 27. As with FIG. 27 the arrangement in FIG. 33 is relatively concrete for illustrative purposes. However where the arrangement in FIG. 27 addressed a tape closure modified before application to closing flaps of a packing box, the arrangement in FIG. 33 addresses a tape closure modified while already engaged with the closing flaps of a packing box.

In FIG. 33, a scanning UV laser adapted to cure a photopolymer layer of a laminated tape engaged with the closing flaps of a medication packing box is disposed 3338 near such tape as has already been applied to the closing flaps of a packing box. It is emphasized that the tape in such case may already be applied in the example as shown; however, it is noted that certain embodiments may be adapted for addressing closures both before and after application, e.g., a single unit may modify tape prior to application or during application, and also may modify tape that has previously been applied. (Arguably such a unit may be called a dispenser, an instiller, or both; as noted previously the terms are not necessarily sharply exclusive.) So long as the modifier is operable and in position so as to enable modifying the photopolymer-layer tape (or other closure) whether such modification happens before, during, or after closure application is not limited.

A digital processor is hardwired 3340 to the UV laser, the digital processor being adapted to convert numeric medication validation codes into cured reinforcement lines on the photopolymer-layer tape. A medication validation code (e.g., facilitating confidence that the medication in the box is genuine) is input 3344 to the processor via a microphone in communication with the processor. For example, a person packaging the medication may recite aloud a numerical code, a word or phrase, etc., to be received by the microphone, interpreted via speech recognition to discern the numerical code or other contents (for example by an encoder such as the digital processor, or some other mechanism; if the encoder is a dedicated processor a different processor may perform speech recognition, while if the encoder is a data entity running on a processor a speech recognition system may exist as a separate data entity on the same processor, etc.), and provided to the digital processor. Regardless of particulars, the processor determines 3346 a configuration of cured lines (e.g., transverse reinforcing lines) to be instilled into the photopolymer laminate tape, based on the medication validation code as input 3344 to the processor.

Still with reference to FIG. 33, the cured line configuration as determined 3346 in the processor is communicated 3348 to the scanning UV laser. The scanning UV laser then scans 3350 a beam of UV light across the photopolymer laminate tape so as to selectively instill the cured line configuration as communicated to the laser. Typically though not necessarily, such a scanning laser mechanism may require (or at least benefit from) additional external manipulation, e.g., considering an instiller in the form of a handheld device the UV laser may scan a window of tape while a user moves the device along the length of the tape so as to instill the cured line configuration along the full length thereof (or at least some substantial portion of the length of the tape). However, this is an example only and other arrangements may be suitable, e.g., a scanning laser with an optical sensor to locate tape within a field of view and scan cure lines therein from some distance without requiring a user to align a window of the device with such tape.

Figure 34:
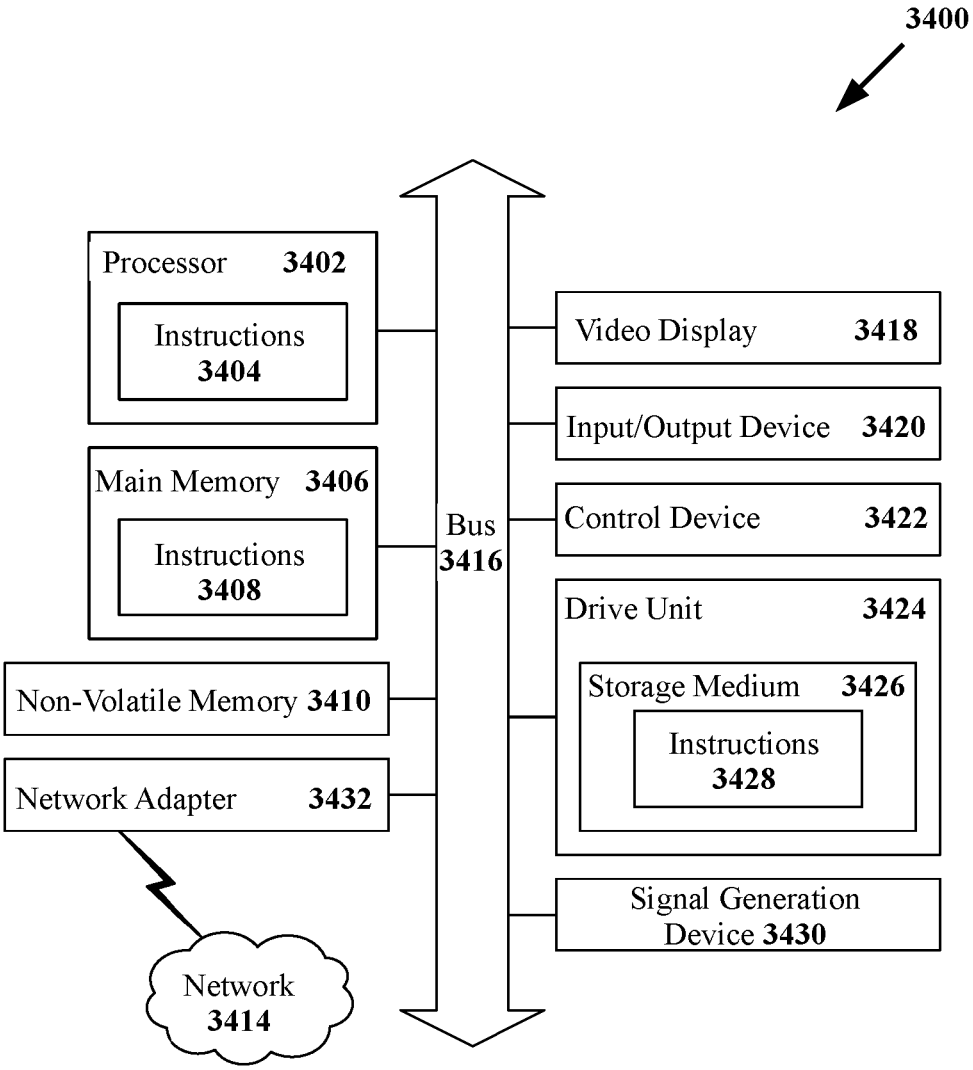
FIG. 34 shows a block diagram illustrating an example of a processing system in which at least some operations described herein can be implemented.

FIG. 34 is a block diagram illustrating an example of a processing system 3400 in which at least some operations described herein can be implemented. The processing system may include one or more central processing units ("processors") 3402, main memory 3406, non-volatile memory 3410, network adapter 3412 (e.g., network interfaces), video display 3418, input/output devices 3420, control device 3422 (e.g., keyboard and pointing devices), drive unit 3424 including a storage medium 3426, and signal generation device 3430 that are communicatively connected to a bus 3416. The bus 3416 is illustrated as an abstraction that represents any one or more separate physical buses, point to point connections, or both connected by appropriate bridges, adapters, or controllers. The bus 3416, therefore, can include, for example, a system bus, a Peripheral Component Interconnect (PCI) bus or PCI-Express bus, a HyperTransport or industry standard architecture (ISA) bus, a small computer system interface (SCSI) bus, a universal serial bus (USB), IIC (I2C) bus, or an Institute of Electrical and Electronics Engineers (IEEE) standard 1394 bus, also called "Firewire."

In various embodiments, the processing system 3400 operates as a standalone device, although the processing system 3400 may be connected (e.g., wired or wirelessly) to other machines. For example, in some embodiments components of the processing system 3400 are housed within a computer device used by a user to access an interface having skin care products or skin care regimens, while in other embodiments components of the processing system 3400 are housed within a network-connected container that holds one or more skin care products. In a networked deployment, the processing system 3400 may operate in the capacity of a server or a client machine in a client-server network environment, or as a peer machine in a peer-to-peer (or distributed) network environment.

The processing system 3400 may be a server, a personal computer (PC), a tablet computer, a laptop computer, a personal digital assistant (PDA), a mobile phone, a processor, a telephone, a web appliance, a network router, switch or bridge, a console, a hand-held console, a (hand-held) gaming device, a music player, any portable, mobile, hand-held device, or any machine capable of executing a set of instructions (sequential or otherwise) that specify actions to be taken by the processing system.

While the main memory 3406, non-volatile memory 3410, and storage medium 3426 (also called a "machine-readable medium) are shown to be a single medium, the term "machine-readable medium" and "storage medium" should be taken to include a single medium or multiple media (e.g., a centralized or distributed database, and/or associated caches and servers) that store one or more sets of instructions 3428. The term "machine-readable medium" and "storage medium" shall also be taken to include any medium that is capable of storing, encoding, or carrying a set of instructions for execution by the processing system and that cause the processing system to perform any one or more of the methodologies of the presently disclosed embodiments.

In general, the routines executed to implement the embodiments of the disclosure, may be implemented as part of an operating system or a specific application, component, program, object, module or sequence of instructions referred to as "computer programs." The computer programs typically comprise one or more instructions (e.g., instructions 3404, 3408, 3428) set at various times in various memory and storage devices in a computer, and that, when read and executed by one or more processing units or processors 3402, cause the processing system 3400 to perform operations to execute elements involving the various aspects of the disclosure.

Moreover, while embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Further examples of machine-readable storage media, machine-readable media, or computer-readable (storage) media include, but are not limited to, recordable type media such as volatile and non-volatile memory devices 3410, floppy and other removable disks, hard disk drives, optical disks (e.g., Compact Disk Read-Only Memory (CD ROMS), Digital Versatile Disks, (DVDs)), and transmission type media such as digital and analog communication links.

The network adapter 3412 enables the processing system 3400 to mediate data in a network 3414 with an entity that may be external to the computing device 3400, through any known and/or convenient communications protocol supported by the processing system 3400 and the external entity. The network adapter 3412 can include one or more of a network adaptor card, a wireless network interface card, a router, an access point, a wireless router, a switch, a multi-layer switch, a protocol converter, a gateway, a bridge, bridge router, a hub, a digital media receiver, and/or a repeater.

The network adapter 3412 can include a firewall that can, in some embodiments, govern and/or manage permission to access/proxy data in a computer network, and track varying levels of trust between different machines and/or applications. The firewall can be any number of modules having any combination of hardware and/or software components able to enforce a predetermined set of access rights between a particular set of machines and applications, machines and machines, and/or applications and applications, for example, to regulate the flow of traffic and resource sharing between these varying entities. The firewall may additionally manage and/or have access to an access control list which details permissions including for example, the access and operation rights of an object by an individual, a machine, and/or an application, and the circumstances under which the permission rights stand.

As indicated above, the computer-implemented systems introduced here can be implemented by hardware (e.g., programmable circuitry such as microprocessors), software, firmware, or a combination of such forms. For example, some computer-implemented systems may be embodied entirely in special-purpose hardwired (i.e., non-programmable) circuitry. Special-purpose circuitry can be in the form of, for example, application-specific integrated circuits (ASICs), programmable logic devices (PLDs), field-programmable gate arrays (FPGAs), etc.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling others skilled in the relevant art to understand the claimed subject matter, the various embodiments, and the various modifications that are suited to the particular uses contemplated.

While embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Although the above Detailed Description describes certain embodiments and the best mode contemplated, no matter how detailed the above appears in text, the embodiments can be practiced in many ways. Details of the systems and methods may vary considerably in their implementation details, while still being encompassed by the specification. As noted above, particular terminology used when describing certain features or aspects of various embodiments should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless those terms are explicitly defined herein. Accordingly, the actual scope of the invention encompasses not only the disclosed embodiments, but also all equivalent ways of practicing or implementing the embodiments under the claims.

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

What is claimed is:

1. An apparatus, comprising:

an adhesive tape adapted to engage flaps of a box, so as to retain said box in a closed state while said adhesive tape is engaged with said flaps, said adhesive tape being frangible so as to release said box from said closed state upon a rupturing of said adhesive tape;

wherein:

said adhesive tape defines a plurality of apertures therethrough distributed along a rupture path;

said adhesive tape is adapted such that said rupturing thereof produces an acoustic emission;

said apertures are adapted to incorporate an acoustic sequential nonuniformity into said acoustic emission; and said apertures are configured along said rupture path so as to encode data, such that upon said rupturing said data is incorporated into said acoustic sequential nonuniformity in said acoustic emission.

2. An apparatus comprising:

a closure adapted to engage a portal, so as to retain said portal in a closed state while said closure is engaged with said portal, at least a portion of said closure being frangible so as to release said portal from said closed state upon a yielding of said at least one portion;

wherein:

said at least one portion exhibits a yield sequential nonuniformity of a yield strength along said at least one portion thereof;

said at least one portion is adapted such that said yielding thereof produces an acoustic emission;

said yield sequential nonuniformity is adapted to incorporate an acoustic sequential nonuniformity within said acoustic emission; and said yield sequential nonuniformity is configured so as to encode data, such that upon said yielding said data is incorporated into said acoustic sequential nonuniformity in said acoustic emission.

3. The apparatus of claim 2, wherein:

said closure comprises a web.

4. The apparatus of claim 3, wherein:

said web comprises at least one of a foil, a metal, a paper, a textile, a plastic film, and a wire with an adhesive thereon.

5. The apparatus of claim 2, wherein:

said sequential nonuniformity of yield strength comprises a plurality of apertures defined through said closure.

6. The apparatus of claim 5, wherein:

said apertures exhibit at least one of:

non-uniform intervals therebetween;

non-uniform size; and non-uniform shape.

7. The apparatus of claim 2, wherein:

said sequential nonuniformity of yield strength comprises a plurality of weakenings of said closure.

8. The apparatus of claim 7, wherein:

said weakenings comprise at least one of:

indentations in said closure;

perforations through said closure;

scoring applied to said closure;

voids defined in said closure;

heat marks on said closure;

chemical transformations of said closure; and a penetrating agent introduced into said closure.

9. The apparatus of claim 7, wherein:

said weakenings exhibit at least one of:

non-uniform intervals therebetween;

non-uniform size;

non-uniform shape; and non-uniform composition.

10. The apparatus of claim 2, wherein:

said sequential nonuniformity of yield strength comprises a plurality of reinforcements of with said closure.

11. The apparatus of claim 10, wherein:

said reinforcements comprise at least one of:

substrate elements applied to said closure;

heat marks on said closure;

chemical transformations of said closure;

a penetrating agent introduced into said closure; and a surface agent applied to said closure.

12. The apparatus of claim 10, wherein:

said reinforcements exhibit at least one of:

non-uniform intervals therebetween;

non-uniform size;

non-uniform shape; and non-uniform composition.

13. The apparatus of claim 10, wherein:

said closure defines a division therein between a first lane and a second lane of said closure; and said reinforcements extend from said first lane to said second lane across said division.

14. The apparatus of claim 13, wherein:

said division exhibits an aperture in said closure.

15. The apparatus of claim 14, wherein:

said division exhibits a weakening of said closure.

16. The apparatus of claim 2, wherein:

said data comprises at least one of:

a name of a contents associated with said closure;

a manufacturer name of said contents;

an ID number for said contents;

a description of said contents;

directions for a use of said contents;

information regarding said contents;

a manufacture date for said contents;

a manufacture location for said contents;

a lot number for said contents;

a serial number for said contents;

a use-by date for said contents;

an ordering date for said contents;

an ordering identity for said contents;

a shipping date for said contents;

a recipient for said contents;

a prescriber for said contents; and a dispenser for said product.

17. The apparatus of claim 2, wherein:

said data comprises validation data for a contents associated with said closure adapted to facilitate distinction between authentic and counterfeit contents.

18. A method, comprising:

establishing a closure adapted to engage a portal, so as to retain said portal in a closed state while said closure is engaged with said portal, at least one portion of said closure being frangible so as to release said portal from said closed state upon a yielding of said at least one portion, and said closure being adapted to produce an acoustic emission upon said yielding; and encoding data in said closure by manifesting a yield sequential nonuniformity of a yield strength along at least one portion of said closure, such that said yield sequential nonuniformity produces an acoustic sequential nonuniformity of said acoustic emission upon said yielding of said at least one portion.

19. The method of claim 18, wherein:

said closure comprises an adhesive tape.

20. The method of claim 18, wherein:

encoding said data in said closure comprises manifesting a plurality of apertures in said closure.

21. The method of claim 20, comprising:

encoding said data in said closure comprises at least one of:

manifesting said apertures with nonuniform intervals therebetween;

encoding said data in said closure comprises manifesting said apertures with nonuniform size; and manifesting said apertures with nonuniform shape.

22. The method of claim 18, wherein:

encoding said data in said closure comprises applying a plurality of weakenings to said closure.

23. The method of claim 22, wherein:

applying said weakenings comprises at least one of:

establishing initiation points in said closure;

defining perforations through said closure;

applying scoring to said closure;

excavating voids in said closure; and applying a penetrating agent to said closure.

24. The method of claim 22, wherein:

said weakenings exhibit at least one of:

non-uniform intervals therebetween;

non-uniform size;

non-uniform shape; and non-uniform composition.

25. The method of claim 18, wherein:

encoding said data in said closure comprises engaging a plurality of reinforcements with said closure.

26. The method of claim 25, wherein:

encoding said data in said closure comprises at least one of:

applying said reinforcements with nonuniform intervals therebetween;

applying first reinforcements and second reinforcements with nonuniform size;

applying said first reinforcements and said second reinforcements with nonuniform shape; and applying said first reinforcements and said second reinforcements with nonuniform composition.

27. The method of claim 25, wherein:

engaging said reinforcements comprises at least one of:

applying substrate elements to said closure;

applying a penetrating agent to said closure; and applying a surface agent to said closure.

28. The method of claim 18, wherein:

said data comprises at least one of:

a name of a contents associated with said closure;

a manufacturer name of said contents;

an ID number for said contents;

a description of said contents;

directions for a use of said contents;

information regarding said contents;

a manufacture date for said contents;

a manufacture location for said contents;

a lot number for said contents;

a serial number for said contents;

a use-by date for said contents;

an ordering date for said contents;

an ordering identity for said contents;

a shipping date for said contents;

a recipient for said contents;

a prescriber for said contents; and a dispenser for said product.

29. The method of claim 18, wherein:

said data comprises validation data for a contents associated with said closure adapted to facilitate distinction between authentic and counterfeit contents.

30. An apparatus, comprising:

means for establishing a closure adapted to engage a portal, so as to retain said portal in a closed state while said closure is engaged with said portal, at least one portion of said closure being frangible so as to release said portal from said closed state upon a yielding of said at least one portion, and said closure being adapted to produce an acoustic emission upon said yielding; and means for encoding data in said closure by manifesting a yield sequential nonuniformity of a yield strength along at least one portion of said closure, such that said yield sequential nonuniformity produces an acoustic sequential nonuniformity of said acoustic emission upon said yielding of said at least one portion.

* * * * *